US005575125A

United States Patent [19]

Lalvani

[11] Patent Number: 5,575,125

[45] **Date of Patent: *Nov. 19, 1996**

[54] PERIODIC AND NON-PERIODIC TILINGS AND BUILDING BLOCKS FROM PRISMATIC NODES

[76] Inventor: Haresh Lalvani, 164 Bank St., Apt. 2B, New York, N.Y. 10014

[ * ] Notice: The term of this patent shall not extend beyond the expiration date of PAT. NO. 5,007,220.

[21] Appl. No.: 684,978

[22] Filed: Apr. 15, 1991

Related U.S. Application Data

[63] Continuation-in-part of Ser. No. 282,991, Dec. 2, 1988, Pat. No. 5,007,220, which is a continuation of Ser. No. 36,395, Apr. 9, 1987.

[51] Int. Cl.[6] ..... E04F 13/00

[52] U.S. Cl. ..... 52/311.2; 52/81.4; 52/DIG. 10

[58] Field of Search ..... 52/311, DIG. 10, 52/311.2, 81.4

[56] References Cited

U.S. PATENT DOCUMENTS

| | | | |
|---|---|---|---|
| 4,133,152 | 1/1979 | Penrose | 52/105 |
| 4,343,471 | 8/1982 | Calvert | 52/311 |
| 4,350,341 | 9/1982 | Wallace | 52/311 |
| 4,537,001 | 8/1985 | Uppström | 52/311 |
| 4,620,998 | 11/1986 | Lalvani | 52/311 |
| 4,723,382 | 2/1988 | Lalvani | 52/DIG. 10 |
| 5,007,220 | 4/1991 | Lalvani | 52/311 |
| 5,036,635 | 8/1991 | Lalvani | 52/DIG. 10 |

OTHER PUBLICATIONS

Lalvani, Haresh; Non–Periodic Space Structures; Jan. 1987.

*Primary Examiner*—Carl D. Friedman
*Assistant Examiner*—Christopher-Todd Kent

[57] ABSTRACT

A family of convex and non-convex tiles which can be tiled together to fill a planar surface in a periodic or non-periodic manner. The tiles are derived from planar space frames composed of a plurality of regular p-sided polygonal nodes coupled by a plurality of struts. p is any odd number greater than three and an even number greater than four. The nodes and struts, along with the areas bounded by them, make up a tiling system. In addition, the lines joining the along the center lines of the struts define a large family of convex and non-convex tiles. The convex tiles include zonogons, and the non-convex tiles include tiles with one or more concave vertices. The latter comprise singly-concave, bi-concave and S-shaped tiles. The tiles can be converted to 3-dimensional space-filling blocks. When these blocks are hollow and inter-connected, architectural environments are possible. Other applications include tiles for walls, floors, and various architectural and other surfaces, environments, toys, puzzles, furniture and furnishings. Special art pieces, murals and sculptures are possible.

22 Claims, 36 Drawing Sheets p=12 p=14 fig. 27
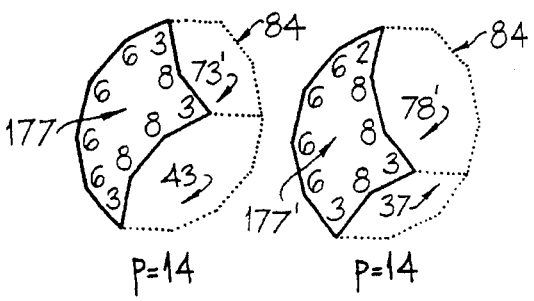
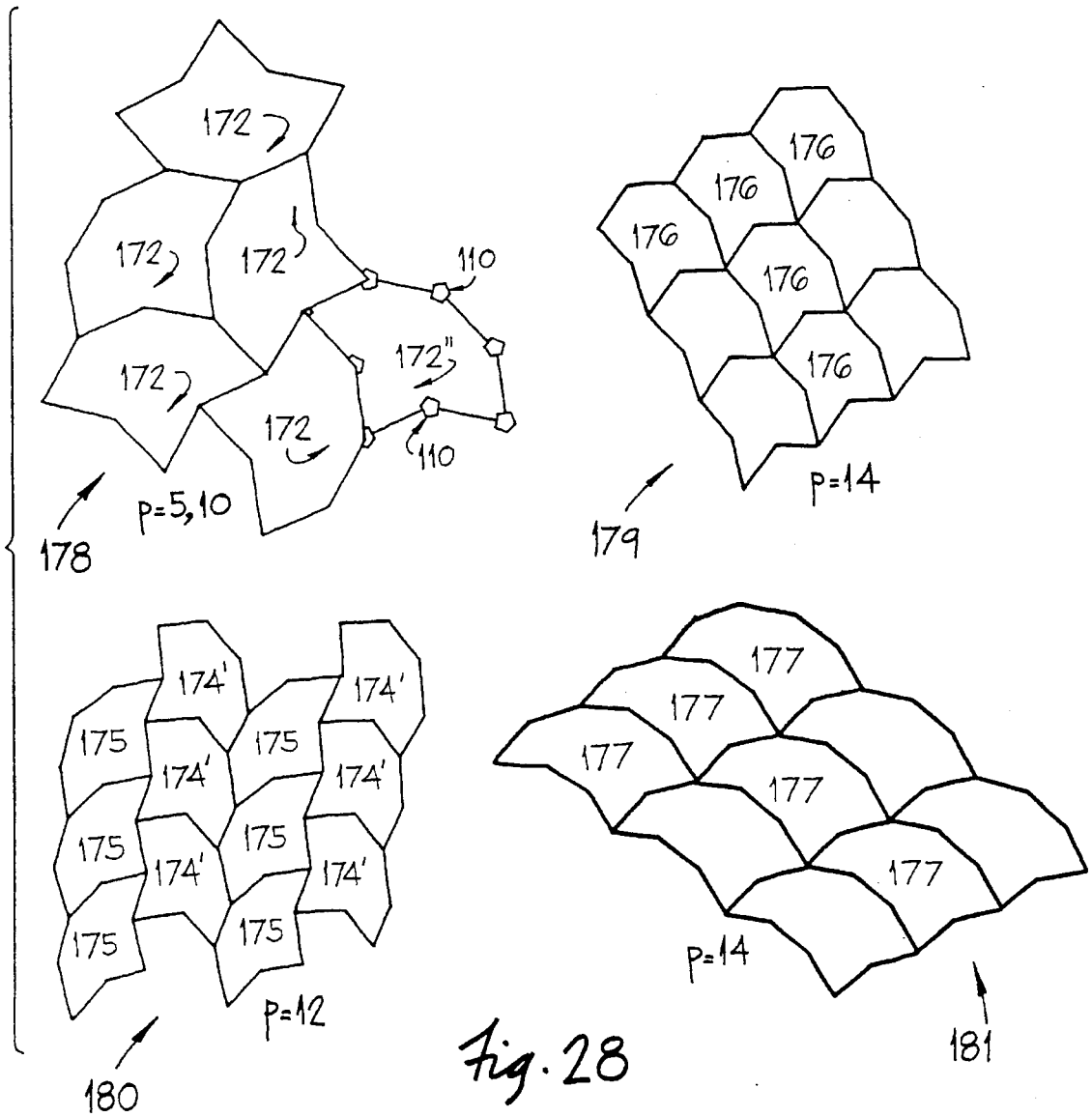
fig. 28

219
P=5
220
P=7
221
P=8
222
P=9
223
P=10
224
P=12

PERIODIC AND NON-PERIODIC TILINGS AND BUILDING BLOCKS FROM PRISMATIC NODES

This application is a Continuation-in-Part of the application Ser. No. 07/282,991, filed Dec. 2, 1988, now U.S. Pat. No. 5,007,220, which is a Continuation of Ser. No. 07/036, 395, filed Apr. 9, 1987, now patented and entitled 'Non-periodic and Periodic Layered Space Frames Havign Prismatic Nodes' (hereafter referred to as the "parent" application).

FIELD OF INVENTION

The invention relates to periodic and non-periodic tiling configurations which are derived from a plurality of polygonal nodes connected by a plurality of struts to form planar configurations. The tiles include a variety of convex zonogons and non-convex polygons. The tiles also define 3-dimensional space-filling blocks and spaces.

BACKGROUND OF THE INVENTION

Modular building systems are of great interest in architecture and building technology, both on earth and in outer space. The advantages go beyond mere novelty of building form or space structure configurations. Besides the integration of geometry and structure, the economy due to few prefabricated elements, easy assembly due to repetitive erection and construction procedures are among the more attractive goals. Among the modular building systems, a system that permits both periodic and non-periodic configurations has the advantage of versatility over systems that do one or the other. In addition, the random-look of non-periodic configurations provide greater visual interest if carried out with an aesthetic sensitivity. Each designer, using a set of tiles from the present invention, could make up his or her own specific design different from others, each new and unique. This is an advantage absent in the periodic tiles and in rule-based non-periodic tiles. In addition, the tiles are fun to play with. Further, if the same pieces can be rearranged in a variety of periodic as well as non-periodic ways, the designer is afforded a great flexibility in the design process.

In some cases, as in the case of masons who lay tiles in architectural environments, the freedom to design his or her own signature tiling pattern exists as a possibility. Another example would be astronauts assembling space structures in orbit. This advantage is inter-active, and designs can be modified as they are being realized. This is a possible advantage that can can be extended to robotic and computer-aided assembly of modular building systems.

This patent focusses mainly on various shapes of tiles and the tiling configurations generated by using these tiles. The tiles can be converted to upright or inclined prisms of any height. Such prisms provide alternative blocks and bricks for physical environments, architecture, art and sculptural objects, toys, games and puzzles. When only the outside surface planes of the prisms are used, and approporiately designed openings are made in these planes, usable and habitable architectural spaces can be defined.

The prior art in this field includes numerous U.S. patents. U.S. Pat. No. 1,474,779 to A. Z. Kammer discloses periodic tiling based on mirror-symmetric even-sided polygons derived from regular polygons. U.S. Pat. No. 4,133,152 to R. Penrose discloses a non-periodic tiling composed of two rhombic tiles based on the pentagon. U.S. Pat. No. 4,223,890 to A. Schoen discloses dissections of regular polygons into rhombii and singly-concave hexagons (i.e. a non-convex polygon with one concavity as described later in this application). U.S. Pat. No. 4,350,341 to Wallace discloses periodic and non-periodic patterns composed of odd-sided singly-concave polygons. U.S. Pat. No. 4,620,998 to H. Lalvani discloses periodic and non-periodic tilings composed of mirror-symmetric crescent-shaped tiles.

H. Lindgren's book 'Recreational Problems in Geometric Dissections & How to Solve Them, (Dover, 1972), presents numerous examples of periodic tilings composed of convex and non-convex tiles obtained from dissections of regular polygons. The book, 'Tilings and Patterns' by B. Grunbaum and G. Shephard, (W. H. Freeman, 1987), presents a large catalog of tilings. The relevant work in this book, in addition to Lindgren and Penrose (already cited), includes a non-periodic tiling based on Harborth's construction and composed of mirror-symmetric hexagons derived from a pentagon (p.52), Amman's non-periodic tiling composed of a square and a 45° rhombus (p.556). In addition, D. R. Simonds (1977, 78) and G. Hatch (1978) in the journal Mathematics Teaching show examples of central and spiral tilings composed of "reflexed" 5-sided, 7-sided and 9-sided polygons. J. Baracs in Structural Topology journal (1979) discloses periodic tilings using convex zonogons.

Prior art, except for a few cases which are excluded in this application, does not teach periodic, non-periodic and central tilings based on 'non-regular zonogons' and non-convex polygons derived from them, where all polygons are based on the concept of the central angles of regular p-sided polygonal nodes. Non-regular zonogons are even-sided convex polygons with a two-fold center of symmetry, and thus exclude the regular polygons which can be termed 'regular zonogons'. The two-fold symmetry requires the edges (and angles) of non-regular zonogons to occur in pairs of opposite and parallel sides (and angles).

SUMMARY OF THE INVENTION

The shapes of the tiles and the configurations of the tiles, or tiling patterns (also termed simply 'tilings') based on regular p-sided prismatic nodes are described in detail. Both periodic, non-periodic and tilings with central symmetry, termed 'central tilings', are described. In the non-periodic tilings disclosed here, the tiles fit randomly, and no attempt has been made to demonstrate any rules which force a non-periodicity. Such rules, which include forcing the tiles to fill the plane non-periodically, are of great mathematical interest. From a designer's point of view, random tilings, without any prescribed rules of how to tile the surface, have a built-in design advantage in that they permit the designer, or the person constructing the tilings in architectural environments, an enormous freedom to improvise as tiles are being laid, or as tiling sequences are being designed. Some of this requires trial-and-error, but as long as the angles of the tiles gaurantee a possible fit, the possibilities are limitless.

The common theme in the large variety of tile shapes and the tilings described herein is that the interior (and exterior) angles of the tiles are integer multiples of the central angles of a regular p-sided polygon. The p-sided polygon corresponds to the regular p-gonal face of the p-sided prismatic nodes described in the parent application. Here the polygonal areas bound by the nodes and struts, or alternatively defined by the center lines of the struts, lead to shapes of tiles. This will become clear with examples described later.

From the large number of possible tilings obtained by using this technique, several classes of known tilings are excluded in the present disclosure.

DRAWINGS

Referring to the drawings which are a part of this disclosure:

FIG. 27 shows two examples of bi-concave decagons obtained by subtracting a hexagons and an adjacent octagon from a dodecagon.

FIG. 28 shows examples of periodic and non-periodic tilings with various bi-concave polygons for FIGS. 26 and 27.

DETAILED DESCRIPTION OF THE INVENTION

There are two ways to obtain tilings from space frames made of p-sided regular prismatic nodes. The first method is more obvious by which planar space frames, i.e. single layers of the space frame, are directly constructed as a tiling pattern composed of 'node-tiles' which occupy the node positions, 'strut-tiles' which replace the strut, and polygonal 'infill-tiles' which fill the area bounded by node-tiles and strut-tiles. The second method is less obvious and was already disclosed in the parent application in FIG. 25. To obtain tilings by this method, the node shapes are "shrunk" to a point and the struts are shrunk to an edge, In doing so, the polygonal areas bounded by the nodes and struts become planar polygonal tiles. The vertices and edges of the tiles corrrespond to the nodes and struts of the space frame, and the angles between the edges of the tiles are same as the angles between the struts meeting at a prismatic node. This way a single layer from the prismatic node space frame system can be directly converted to a tiling system.

Tiling patterns obtained by both methods are described. These include periodic, non-periodic and tilings with central symmetry. Periodic tilings fill a planar surface by a translational symmetry in two directions. Tilings with central symmetry have a p-fold or a (p/2)-fold center of symmetry, and the tiling pattern radiates outwards from this center. Non-periodic tilings disclosed here are of two additional types: the first type has a row of tiles which fit sided-by side in a non-periodic sequence and this entire row is then repeated with a translational symmetry in the second direction. Such a non-periodic tiling is linearly non-periodic. The second type has no translational symmetry in any direction.

In describing the tilings, the regular p-sided prismatic nodes are thought of as regular p-sided polygons instead of prisms. It is thus convenient to describe the face angles (interior angles between adjacent edges) of the tiles in terms of the central angle A of a regular p-sided polygon. The central angle A, the angle subtended by the edge of the regular polygon at its center, equals 360°/p and is also the supplementary angle of the face angle. The angles of all tiles described herein, both convex and non-convex, can be described as integral multiples of angle A. For convenience, the face angles of the polygons will be given in terms of integer only, dropping the A. This integer will be referred to as the 'angle-number'. The exact angle can be calculated by multiplying the angle-number by A. This usage will become clear with an example.

Figure 1:
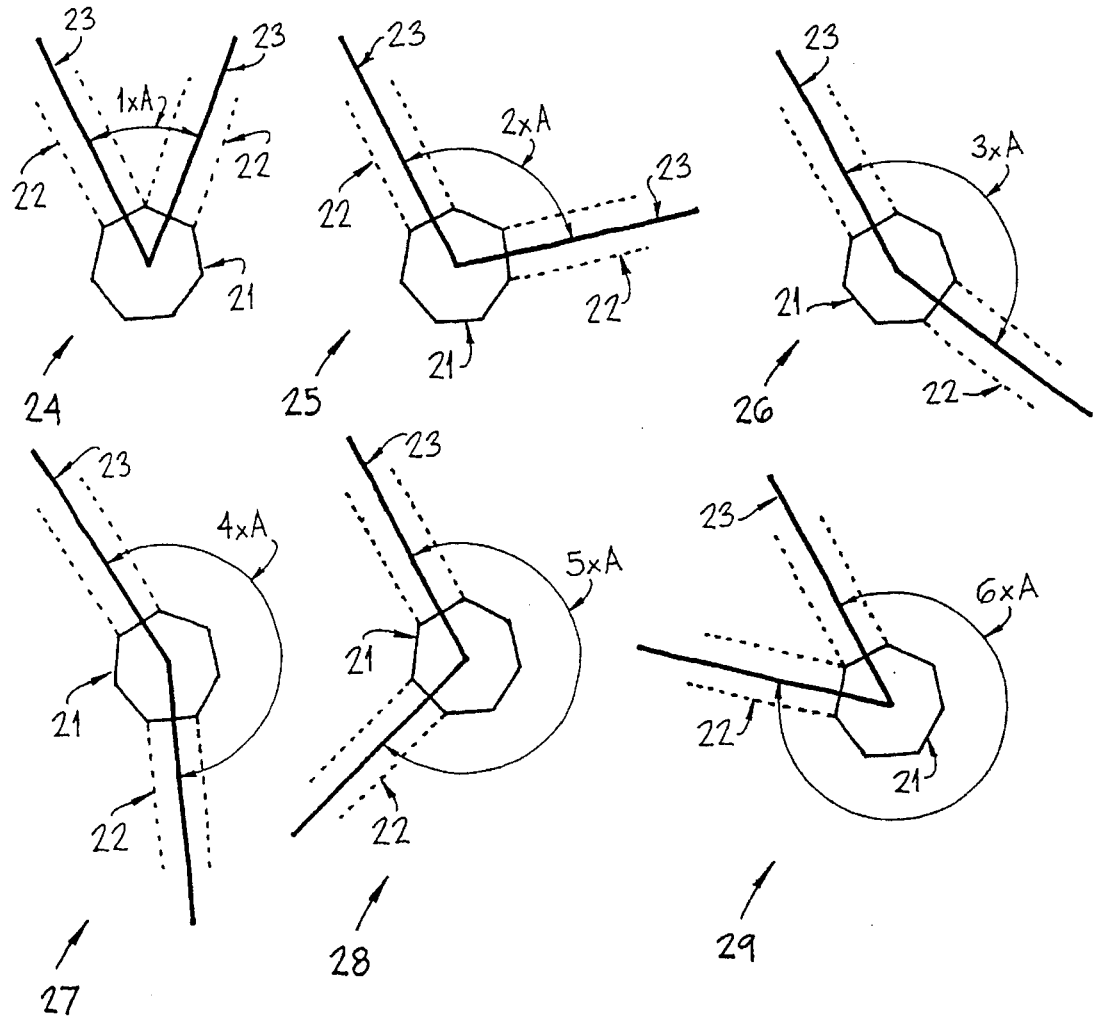
FIG. 1 shows the concept of deriving a vertex of a polygonal tile from a pair of struts meeting at a node; the concept of angle-number's (defined in the text) is also introduced here.

FIG. 1 shows the example of different angles obtained from a single regular polygon, in this case the heptagon 21, i.e. p=7 case. The regular heptagon corresponds to the heptagonal prism node in the parent application, and the "strut" radiating from this node is shown as a pair of dotted lines 22. The edge 23 (shown heavy) is obtained by shrinking the strut. The six illustrations 24–29 show six distinct angles between a pair of edges which meet at the center of the heptagonal node. In illustration 24, this angle equals A. In the remaining illustrations 25–29, the angle is 2A, 3A, 4A, 5A and 6A, respectively. The angle-numbers for the six angles are thus 1, 2, 3, 4, 5 and 6. Since p=7, A=360/7=51.428571 . . . degrees or approximately 51.49°, and the other five angles are twice, three times, four, five and six times this angle. Similarly, the angles from other values of p can be derived.

Figure 2:
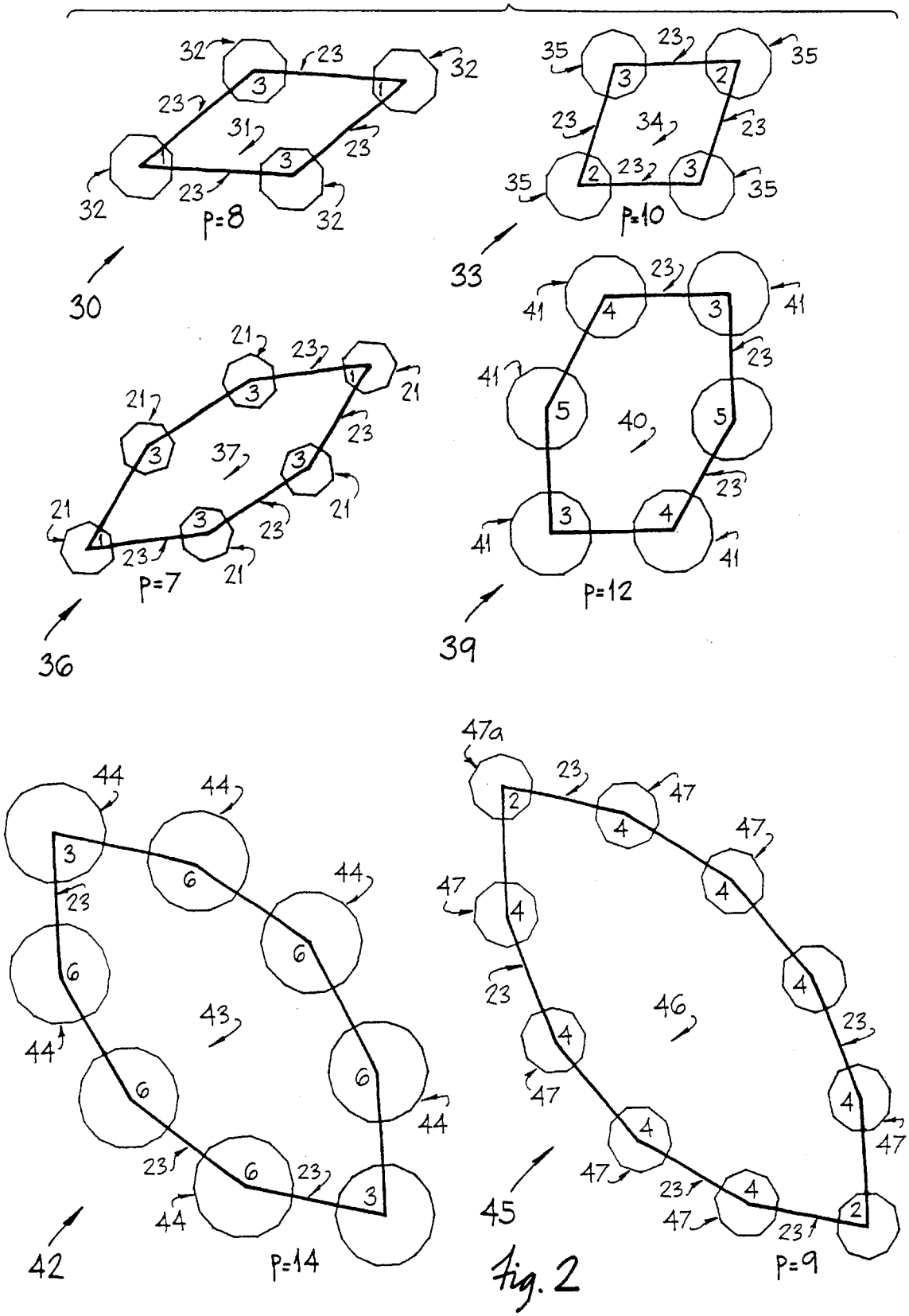
FIG. 2 shows six examples of convex zonogons, including two rhombii, obtained from various p-sided polygonal nodes.

In FIG. 2, six examples of convex zonogons are shown. All six examples are composed of edges 23 but are based on different regular polygonal nodes. In some cases, the number of sides is also different. The values of p is indicated with each example. The face angles for each zonogon are indicated by an integer placed inside the polygon at each vertex; the value of this integer can be visually checked by counting the number of edge segments of the polygonal node that are contained within the zonogon at that vertex. As in the previous case, all integers have to be multiplied by A to obtain the exact angle.

Illustration 30 shows a rhombus 31 from the octagonal node 32 (p=8 case) with interior angle-numbers 1 and 3. Illustration 33 shows a different rhombus 34 from the decagonal node 35 (p=10 case) with interior angle-numbers 2 and 3. Illustration 36 shows a hexagon 37 from heptagonal node 38 (p=7); its interior angles are represented by the integers 1 and 3. The illustration 39 shows the hexagon 40 from p=12 nodes with interior angle-numbers 3,4 and 5. The illustration 42 shows an octagon 43 from p=14 nodes and has interior angle-numbers 3 and 6. The decagon 46 in illustration 45 is obtained from p=9 nodes and has interior angle-numbers 2 and 4; the nodes at the two acute vertices are marked 47*a* and 47*b*. All zonogons in this figure have a two-fold symmetry of rotation along with two mirror planes except the hexagon 40 which has a 2-fold symmetry without mirror planes. These two symmetry types characterize all convex zonogons after excluding the regular polygons with even number of sides which are also zonogons.

Figure 3:
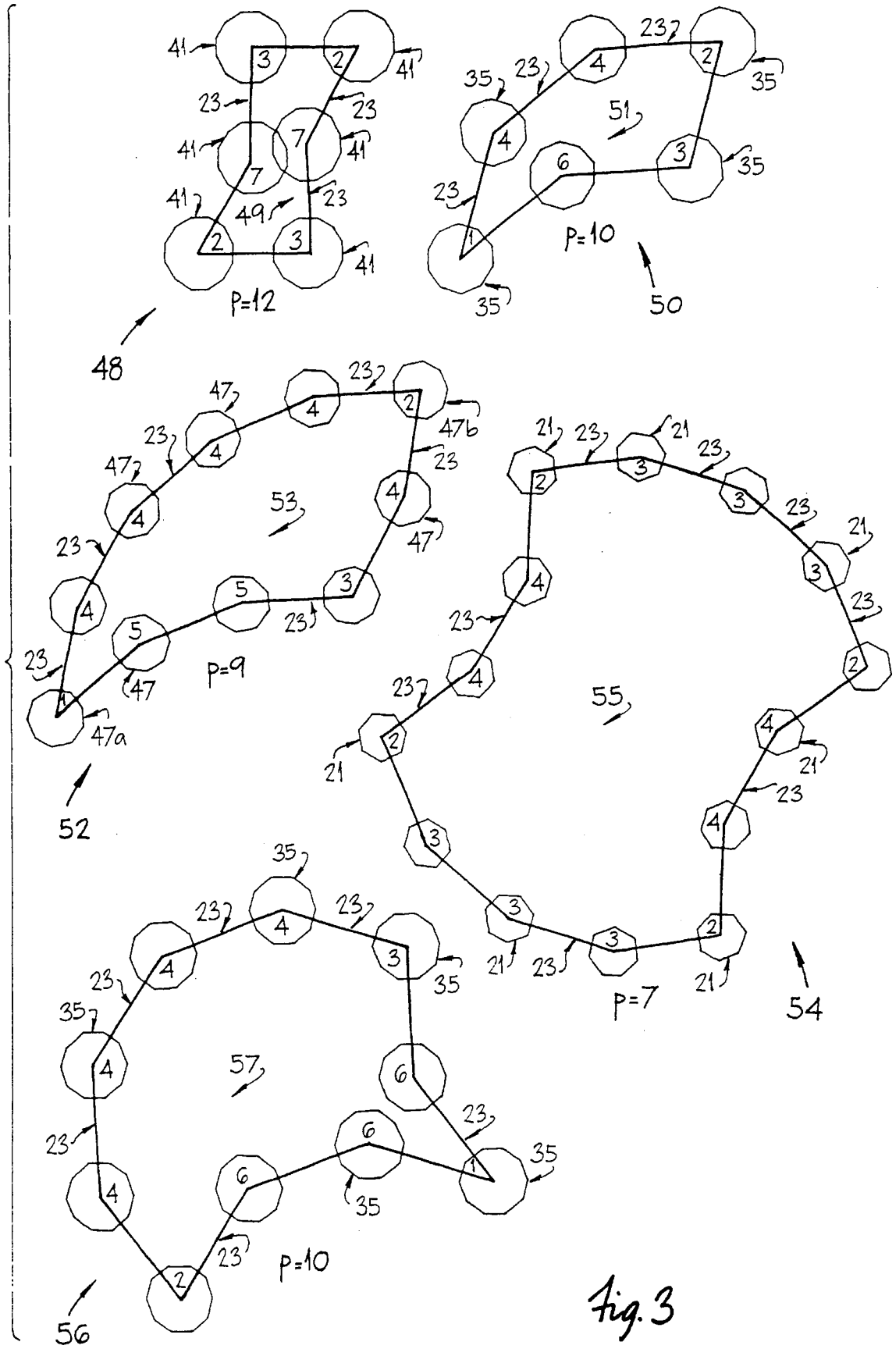
FIG. 3 shows five examples of non-convex polygons obtained from various p-sided polygonal nodes.

FIG. 3 shows five examples of even-sided non-convex polygons, also composed of edges 23 and derived from various regular polygonal nodes. Illustration 48 and 50 show two different types of non-convex hexagons, illustrations 52 and 56 show two different types of non-convex decagons, and illustration 54 is a non-convex 14-sided polygon. Non-convex polygons can be derived by subtracting (removing) a convex polygon from another convex polygon. Different non-convex polygons can be described in terms of the number of concave vertices in the polygon, where the angle number at each concave vertex is greater than p/2.

Illustration 48 is a 'bi-concave' (or doubly-concave or 2-concave) hexagon 49 with a 2-fold rotational symmetry based on p=12 nodes and interior angle-numbers 2, 3 and 7. It can be derived from 39 and has two concave vertices. Illustration 50 is an asymmetric singly-concave hexagon 51 from p=10 nodes and interior angle-numbers 1,2,3,4 and 6. Illustration 52 is a singly-concave decagon 53 based on p=9 nodes and interior angle-numbers 1,2,3,4 and 5. It has two concave vertices and can be derived from 45 with which it shares the nodes 47*a* and 47*b*. Illustration 54 is a 14-sided bi-concave polygon 55 based on p=7 nodes and can be obtained from a regular 14-sided polygon. It has a 2-fold symmetry with two mirror planes, its interior angle-numbers are 2, 3 and 4, and it has four concave vertices. Illustration 56 shows an asymmetric bi-concave decagon 57 with p=10 nodes. It can be obtained from a regular decagon and its interior angle-numbers are 1,2,3,4 and 6, and it has three concave vertices.

The sum of the interior angle-numbers, I, of both convex and non-convex even-sided polygons obtained from p-sided polygonal nodes are integer multiples of p. This is given by the simple relation I=((m–2)/2)p.A, where m is the number of sides of an even-sided convex or non-convex polygon, and where p is any number greater than 2. This is summarized in Table 1.

TABLE 1

| no. of sides of even-sided polygonal tile# m | sum of interior angle-numbers as multiples of A* 1 |
|---|---|
| 4 (rhombii) | p |
| 6 (hexagons) | 2p |
| 8 (octagons) | 3p |
| 10 (decagons) | 4p |
| 12 (dodecagons) | 5p |
| 14 (tetrakaidecagons) | 6p |
| . | . |
| . | . |
| . | . |
| m-gon | ((m – 2)/2)p |

#includes both convex and non-convex tiles

*A = 360°/p, where p equals the no. of edges of p-sided regular polygonal node.

Figure 4:
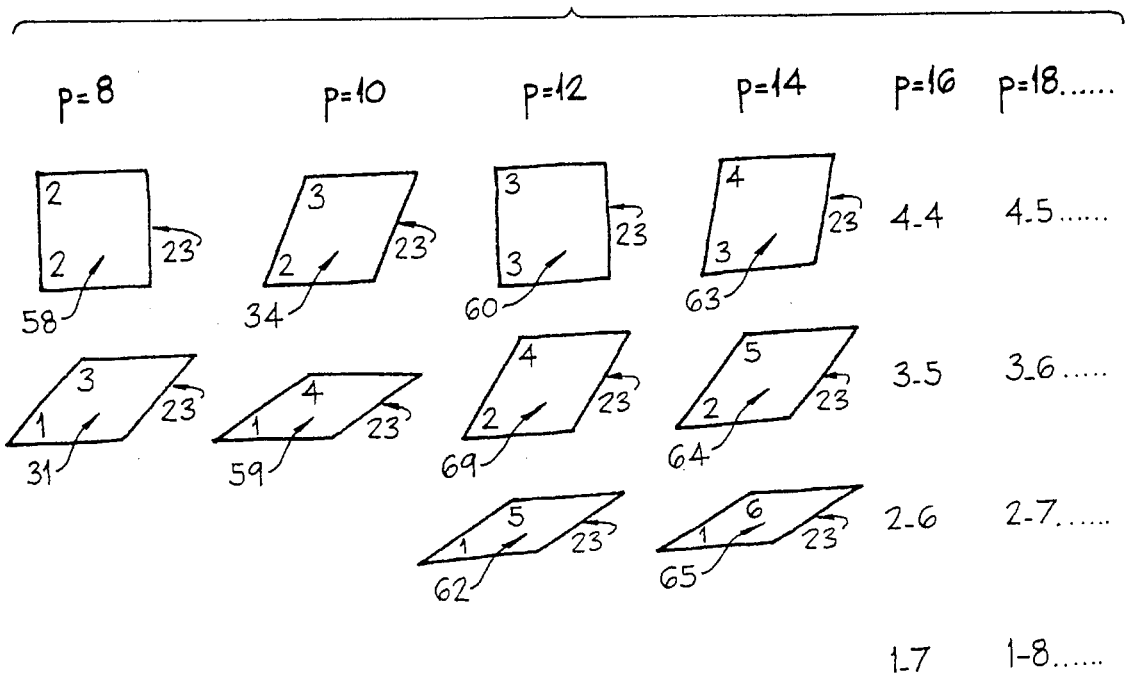
FIG. 4 shows a table of rhombii derived from different values of p. Rhombii from p=8,10, 12, 14, 16, 18 . . . are shown.

FIGS. 4–8 show a partial listing of convex zonogons derived from p-sided polygonal nodes and composed of edges 23. The figures are in vertical columns and list various polygons from even values of p. The rhombii (m=4) are shown in FIG. 4, the hexagons (m=6) in FIG. 5, the octagons (m=8) in FIG. 6, the decagons (m=10) in FIG. 7 and the 12-sided zonogons (m=12) in FIG. 8. In each figure, the polygonal nodes are not shown. The interior angle-numbers at the vertices on only one half of the zonogons are indicated by integers since the other half is the same due to the 2-fold symmetry of non-regular zonogons. From these angle-numbers, the precise angles for each zonogon can be obtained by multplying the integers with A. The figures shown are part of an infinite number of tables, where each figure shows a finite portion of a separate infinite table. In each figure, zonogons for p=8, 10, 12 and 14 only are shown, and the figures can be extended for higher values of p. Similarly zonogons with higher values of m can be shown in additional figures.

In FIG. 4, p=8 column shows two rhombii S8 and 31 (the latter was shown earlier in illustration 30 of FIG. 2), the column p=10 also shows two rhombii 34 and 59 (the former was also shown earlier in illustration 33 of FIG. 2), the columns p=12 and 14 show three rhombii each, 60–62 and 63–65, respectively. The sum of interior angle-numbers, I, in each column equals p, and the sum of interior angles equals p.A. Since the opposite angles in each rhombus are equal, each rhombus can be characterized by a pair of angle-numbers or integer-pairs. Thus in columns p=16 and 18, only the angle-number pairs are given as integer-pairs. Clearly, all distinct pairs of integers which add up to p/2 give a list of all possible rhombii. Note that the rhombii can only be constructed from even-sided polygonal nodes. However, in the case of higher zonogons with even angle-numbers, odd-sided nodes with p/2 sides (where p is even) can be used.

Figure 5:
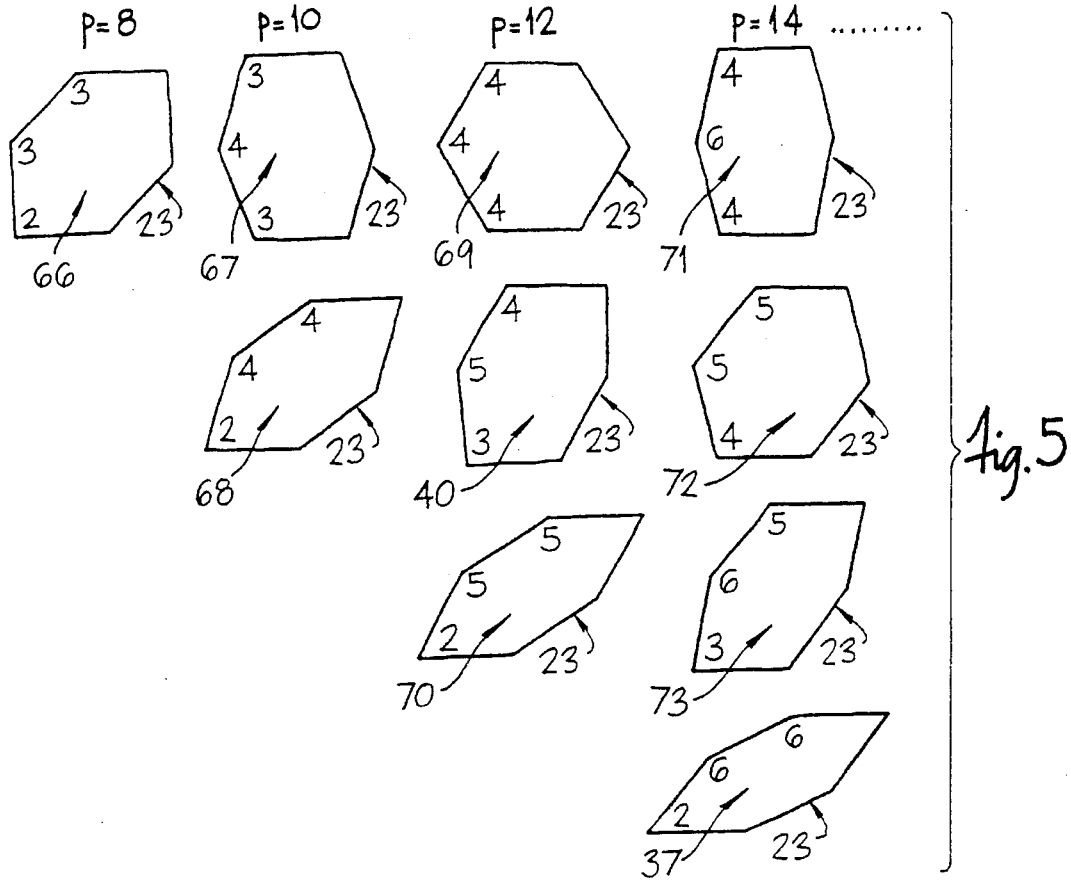
FIG. 5 shows a table of convex hexagons derived from p=8, 10, 12, 14 . . . .

In FIG. 5, all hexagons (m=6) for the even cases p=8 through 14 are shown. The three angle-numbers are given for each, and the remaining three are the same by symmetry. The sum of interior angles equals 2p.A. All hexagons, and all higher zonogons, can be decomposed into rhombii of FIG. 4. All hexagons with even angle-numbers can also be constructed from odd-sided polygonal nodes with p/2 sides. Thus under column p=10, the hexagon 68 can also be constructed from a regular pentagonal node. 69, under column p=12, can also be constructed from a regular hexagonal node, and the hexagons 71 and 37, p=14, can also be constructed from heptagonal nodes. The hexagon 37 was shown earlier in illustration 36 of FIG. 2.

Figure 6:
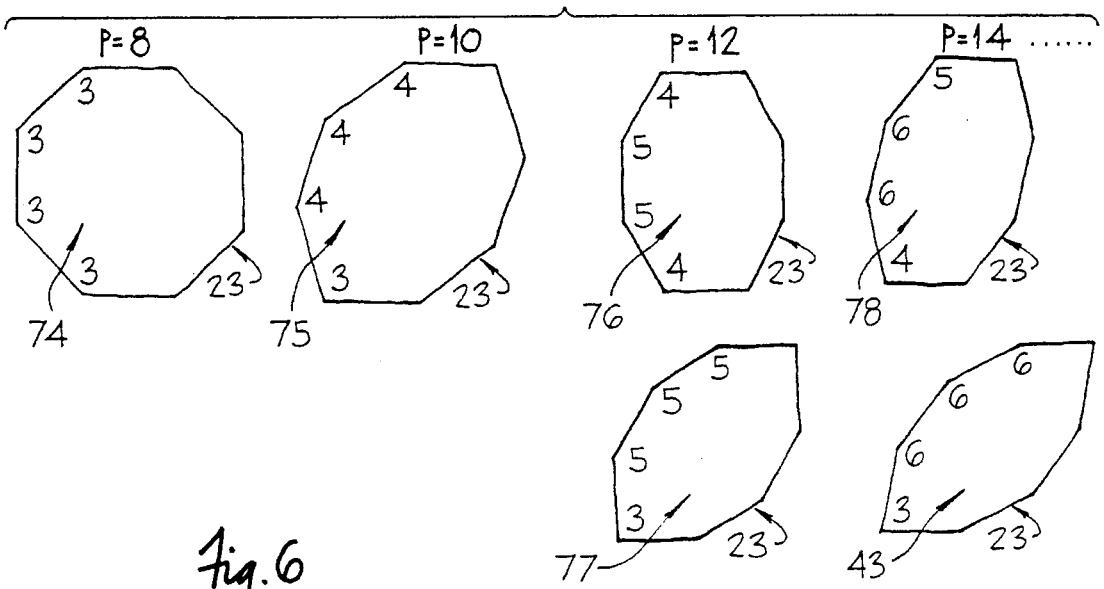
FIG. 6 shows a partial list of convex octagons from p=8, 10, 12, 14, . . . .

FIG. 6 shows a partial list of octagons (m=8) for p=8 through 14. The sum of interior angles equal 3p.A. None of the octagons shown can be constructed from (p/2)-sided nodes. The octagon 43, p=14, was shown earlier in illustration 42 of FIG. 2.

Figure 7:
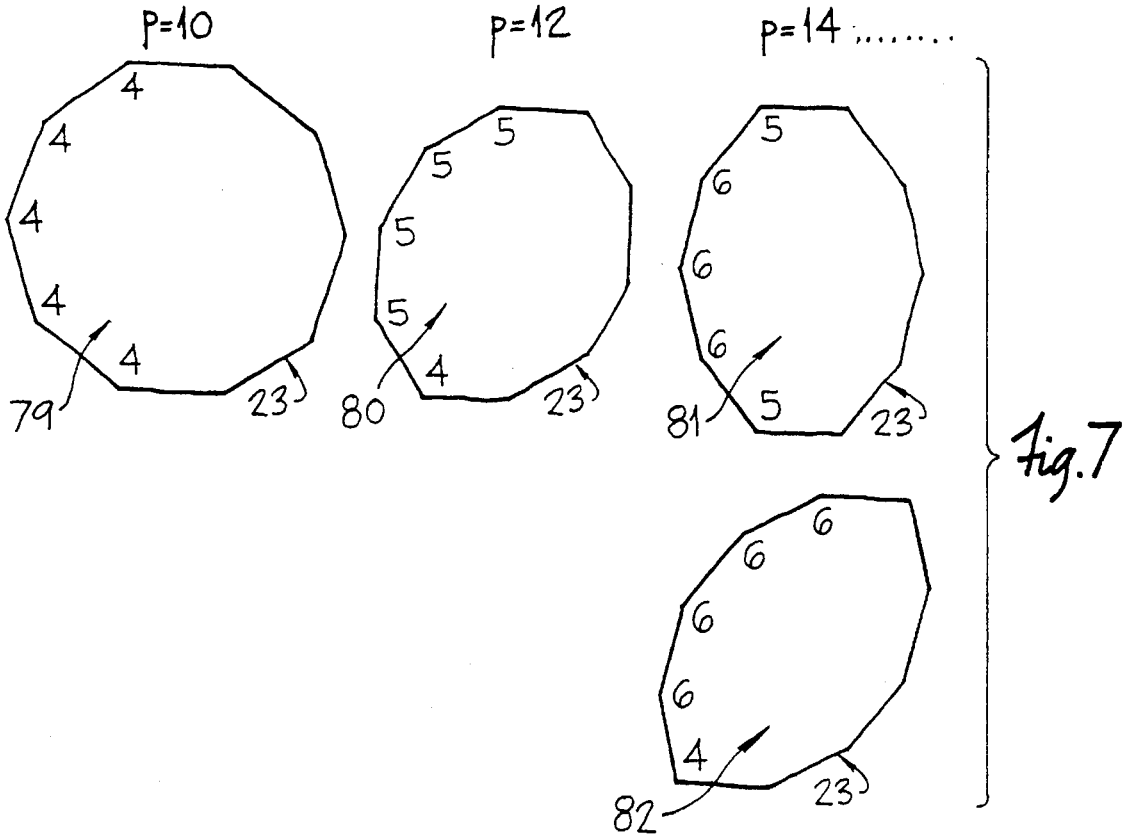
FIG. 7 shows a partial list of convex decagons from p=10, 12, 14, . . . .

FIG. 7 shows a partial list of decagons (m=10) for p=10, 12 and 14 cases. The sum of interior angles equals 4p.A. The decagon 82, p=14, can also be constructed from heptagonal nodes.

Figure 8:
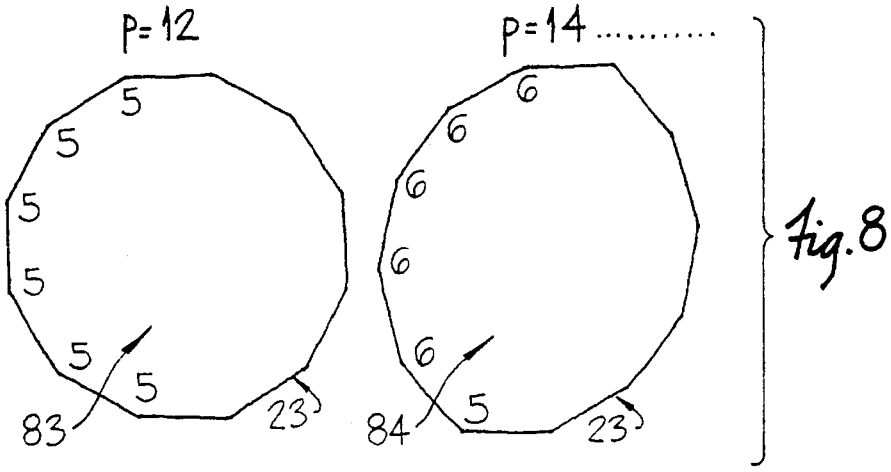
FIG. 8 shows a partial list of convex dodecagons from p=12, 14, . . . .

FIG. 8 shows a partial list of 12-sided zonogons (m=12) from p=12 and 14 only. The sum of interior angles equals 5p.A. Here again, dodecagons with even angle-numbers can be constructed from (p/2)-sided regular polygonal nodes. Similar figures can be shown for all higher values of m.

Figure 9:
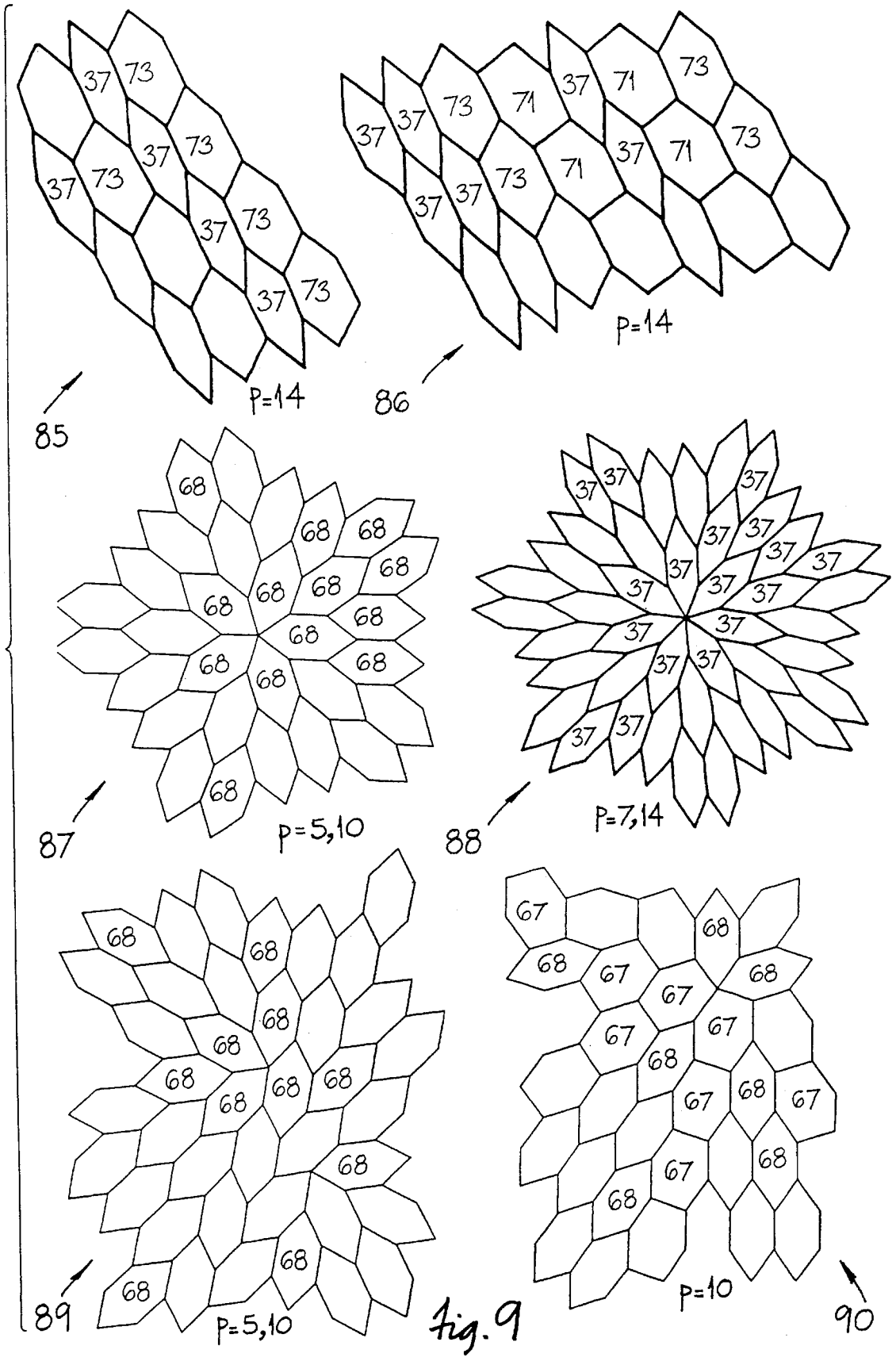
FIG. 9 shows various periodic, central and non-periodic tilings from convex zonogons.

FIG. 9 shows examples of periodic and non-periodic tilings patterns using convex hexagons. Tiling pattern 85, p=14, is a periodic tiling composed of two hexagons 37 and 73. Tiling 86, p=14, is non-periodic and is composed of three different hexagons 37, 71 and 73 arranged in rows. Tiling 87, composed of hexagons 68 from p=5 or p=10 nodes, has central 5-fold symmetry and is based on FIG. 6 of the parent application. Tiling 88, p=7 or 14, is a central tiling with 7-fold symmetry composed of hexagons 37. Similar radial patterns which radiate symmetrically from the center and have mirror symmetry can be obtained from other hexagons. Tiling 89, p=10, is a non-periodic tiling using a single hexagon 68. 90, also p=10, is a non-periodic tiling using two hexagons 67 and 68.

Figure 10:
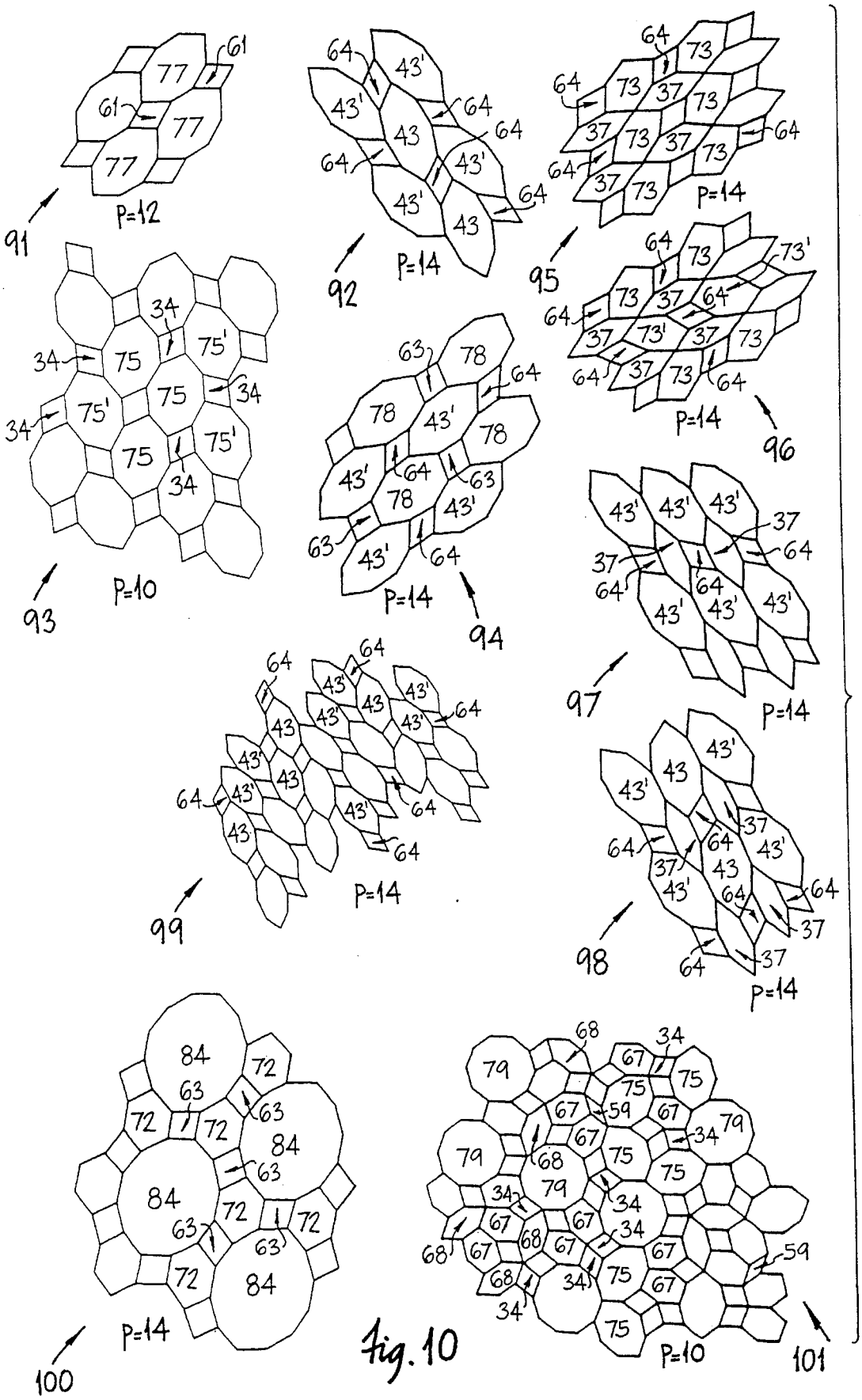
FIG. 10 shows various periodic and non-periodic tilings from various convex zonogons.

FIG. 10 shows eleven examples of tilings with convex zonogons from the p=10, 12 and 14 cases.

Tilings 91–94 are examples that use octagons and rhombii in a periodic manner. Tiling 91, based on p=12, has a simple translation along two directions and uses octagons 77 and rhombii 61. Tiling 92, based on p=14, uses octagons 43 and 64 in a zig-zag manner it has glide reflection, and uses right-handed and left-handed octagonal zonogons which are indicated by 43 and 43'. Tiling 93 is similar to 92 but based on p=10, and uses octagons 75 and 75', and rhombii 34. Tiling 94, based on p=14, uses two types of octagons 43' and 78, and two types of rhombii 63 and 64, in an alternatingly periodic manner.

Tilings 95 and 96, both based on p=14 nodes, are periodic and composed of hexagons and rhombii. Tiling 95 has hexagons 73 and 37, and rhombii 64, used in a two -directional translation. Tiling 96 has mirror planes and a glide reflection, and is composed of hexagons 37, 73 and 73', and rhombii 64.

Tilings 97 and 98, also p=14 cases, are composed of octagons, hexagons and rhombii. While 97 shows simple translation with hexagons 43' and 37, and rhombii 64, the tiling 98 has mirror planes and glide reflection. The latter also has the hexagon 43, the mirror-image of 43'.

Tiling 99 is a non-periodic example based on p=14 and is composed of octagons 43 and 43', and rhombii 64. It is composed of parallel rows of octagons 43 and rhombii 64 which alternate randomly with parallel rows of octagons 43' and rhombii 64.

Tiling 100, based on p=14, is a periodic tiling composed of dodecagons 84, hexagons 72 and rhombii 63.

Tiling 101, based on p=10, is a non-periodic tiling composed of all the convex zonogons from 10-sided nodes. The regular decagons 79, the octagons 75, the two hexagons 67 and 68, and the two rhombii 34 and 59 are tiled randomly.

Figure 11:
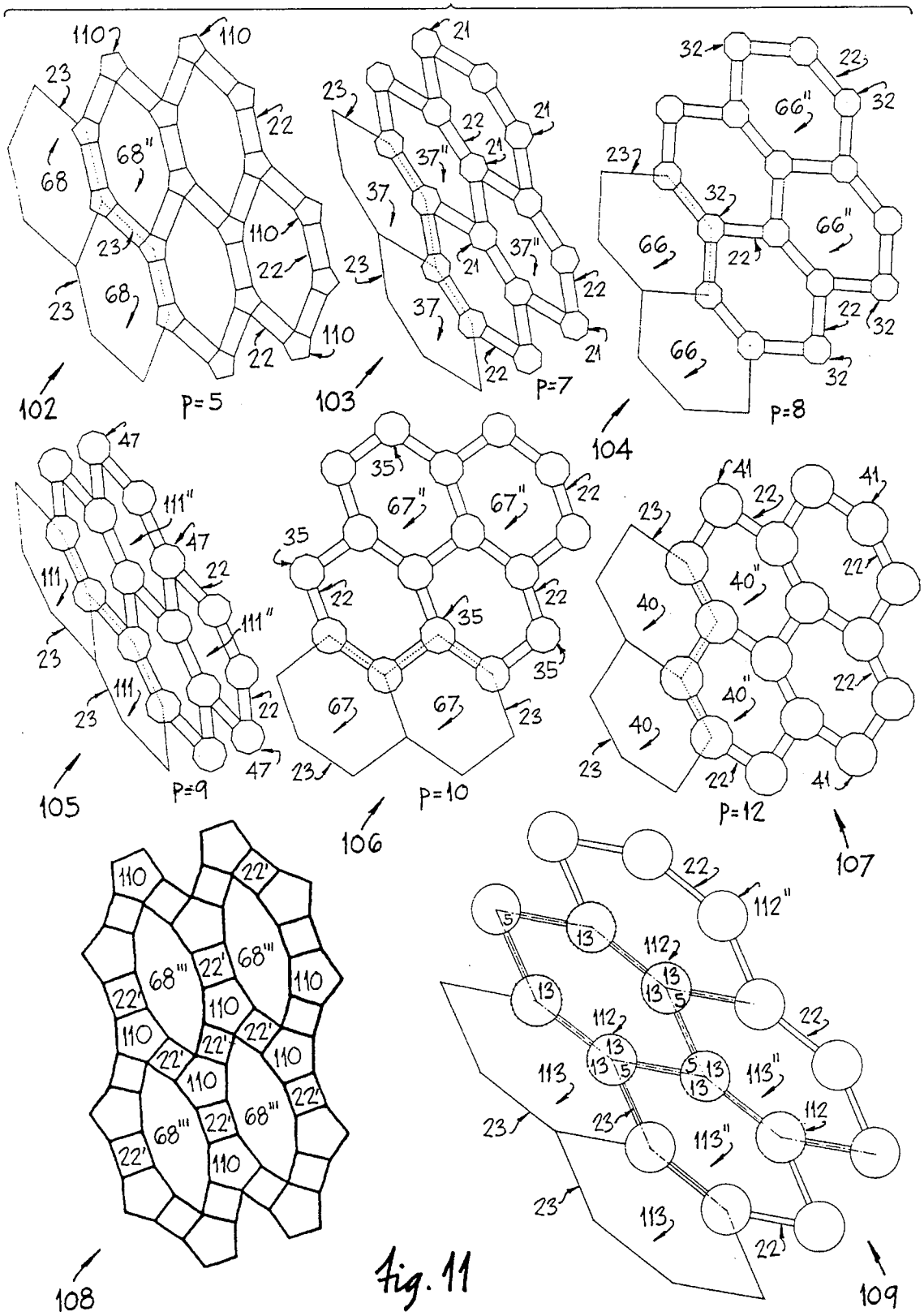
FIG. 11 shows various periodic tilings composed of three different tiles, a node-tile, a strut-tile and an infill-tile.

FIG. 11 shows eight examples of periodic tilings based on different regular polygonal nodes and struts. The tiling patterns thus consist of three different types of tiles: a node-tile, a strut-tile 22 and an infill-tile which fits in the areas bound by the other two. In each case, when the center lines 23 of the struts are joined at the center of the node-tiles, a periodic array of hexagons is obtained. Two such hexagons are shown on the left part of the tilings. The infill-tiles can be obtained from these hexagons by suitably cutting out polygonal portions at its vertices to fit the node-tiles.

Tiling 102, p=5 case, uses pentagonal node-tiles 110, rectangular strut-tiles 22, and the infill-tiles 68" derived from the hexagons 68.

Tiling 103, p=7 case, uses heptagonal node-tiles 21, rectangular strut-tiles 22, and the infill-tiles 37" derived from the hexagons 37.

Tiling 104, p=8 case, uses octagonal node-tiles 32, rectangular strut-tiles 22, and the infill-tiles 66" derived from the hexagons 66.

Tiling 105, p=9 case, uses nonagonal node-tiles 47, rectangular strut-tiles 22, and the infill-tiles 111" derived from the hexagons 111.

Tiling 106, p=10 case, uses decagonal node-tiles 35, rectangular strut-tiles 22, and the infill-tiles 67" derived from the hexagons 67.

Tiling 107, p=12 case, uses dodecagonal node-tiles 41, rectangular strut-tiles 22, and the infill-tiles 40" derived from the hexagons 40.

Tiling 108, p=5 case, uses pentagonal node-tiles 110, square strut-tiles 22, and the infill-tiles 68'''. This tiling is a variant of 102.

Tiling 109, p=31 case, uses 31-sided regular polygonal node-tiles 112, strut-tiles 22, and the infill-tiles 113" based on the hexagons 113 shown on the left side of the tiling. The angle-numbers at the center of the tiles 112 are given to demonstrate the angular fit. Alternatively, completely circular tiles 112" could be used, thereby suitably modifying the corners of the infill-tiles into arcs of circles. A variant of such tiling patterns could be to use arbitrary angles with circular node-tiles.

FIGS. 12–20 show non-convex tiles with a single concave vertex and tiling patterns obtained from such tiles.

Figure 12:
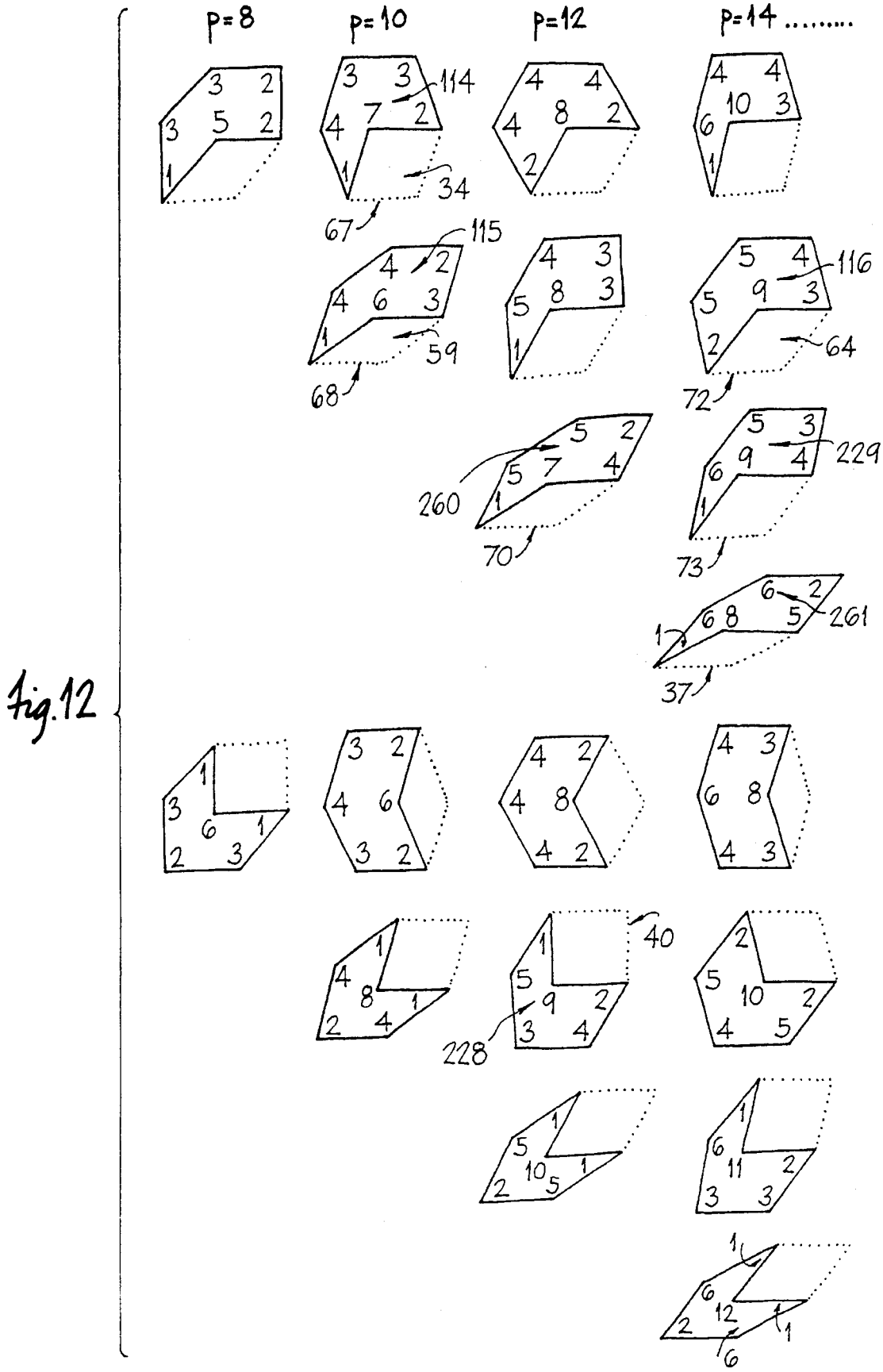
FIG. 12 shows a partial list of singly-concave hexagons with one concave vertex-obtained by removing a rhombus from a convex hexagon.

FIG. 12 shows non-convex hexagons for the p=8, 10, 12 and 14 cases arranged under respective columns. These non-convex hexagons can be obtained by subtracting the rhombii of FIG. 4 from the corresponding convex hexagons of FIG. 5. For example, under column p=10, the non-convex hexagon 114 can be derived by removing the rhombus 34 from the hexagon 67. Similarly, the non-convex hexagon 115 cav be derived by removing the rhombus 59 from the hexagon 68. Both hexagons 114 and 115 are asymmetric and exist in left-handed and right-handed states depending on whether the rhombus is subtracted from the left or right side of the convex hexagon. The examples illustrated in FIG. 12 show tiles with only one type of handedness along with tiles having mirror symmetry. All interior angle numbers are indicated and the sum of interior angle numbers in the singly-concave non-convex hexagons equals 2p. Such non-convex hexagons have three obtuse angles, each with angle numbers less than p/2, two acute angles, and one concave angle with angle number greater than p/2 at the concave vertex.

Figure 13:
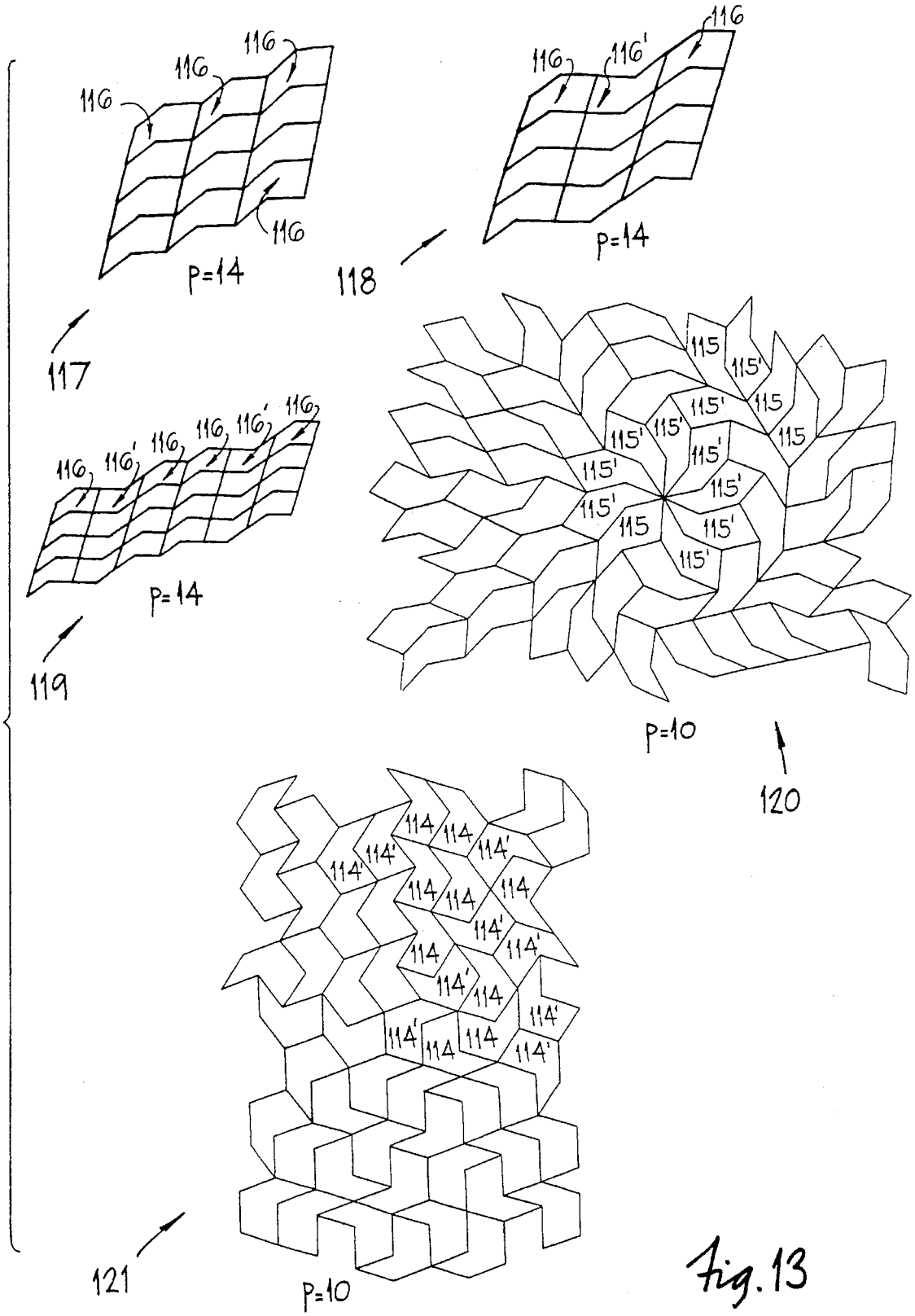
FIG. 13 shows examples of periodic and non-periodic tilings from singly-concave hexagons.

FIG. 13 shows tilings composed of hexagons with one concave vertex. The tiling 117 shows a periodic tiling with a single asymmetric hexagon 116. This hexagon is based on the p=14 nodes and is obtained by subtracting the rhombus 64 from the hexagon 72. The tiling 118 is also periodic and based on p=14 case, but is made up of both left-handed and right-handed tiles 116 and 116'. The tiling 119 is a linearly non-periodic since the inclined columns of tiles 116 and 116' can be alternated non-periodically. The tiling 120 is based on p=10 and is a non-periodic tiling from right- and left-handed tiles 115 and 115'. The tiling 121 is also non-periodic and based on p=10, but is composed of right- and left-handed tiles 114 and 114'.

Figure 14:
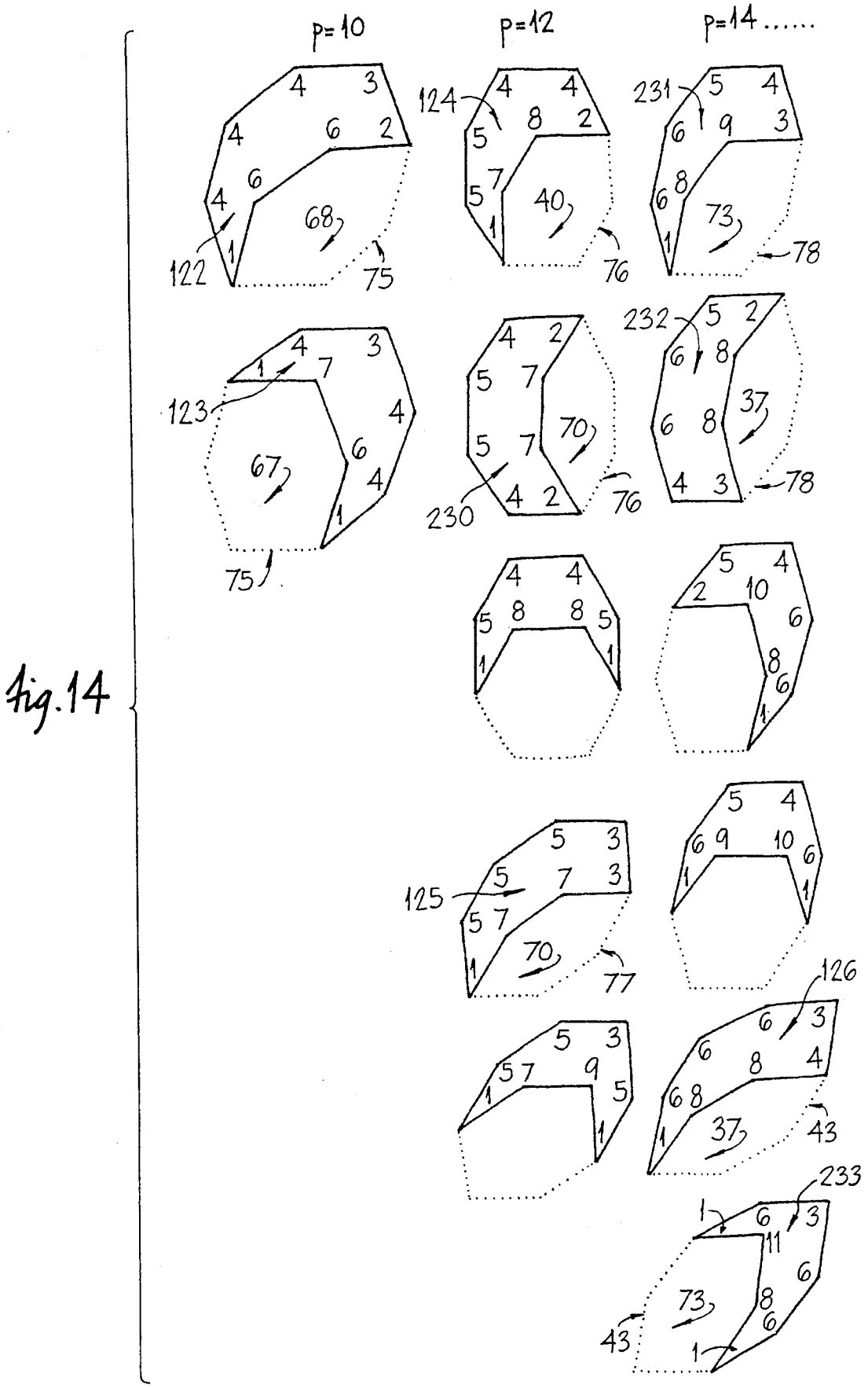
FIG. 14 shows a partial list of singly-concave octagons with two concave vertices obtained by removing a convex hexagon from a convex octagon.
Figure 15:
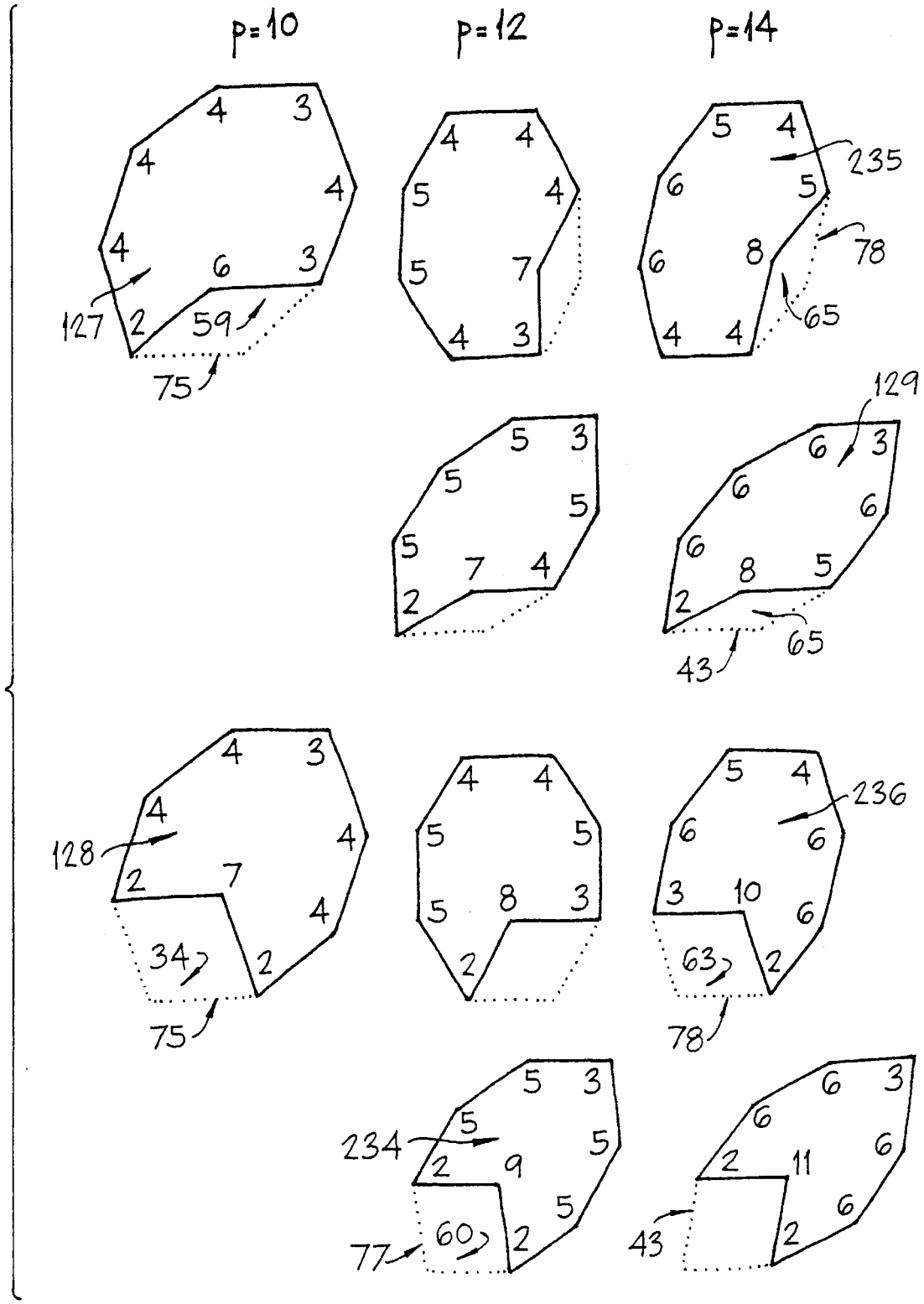
FIG. 15 shows a partial list of singly-concave octagons with one concave vertex obtained by subtracting a rhombus from an octagon.

FIGS. 14 and 15 show singly-concave octagons, the former with with two concave (or inverted) vertices, and the latter with one concave (inverted) vertex.

In FIG. 14, the singly-concave octagons are obtained by subtracting the convex hexagons of FIG. 5 from the convex octagons of FIG. 6. For example, octagon 122, p=10, is obtained by subtracting the hexagon 68 from the convex octagon 75. Similarly, the non-convex octagon 123, also p=10, is obtained by subtracting the hexagon 67 from the same convex octagon 76. For p=12 case, the non-convex octagon 124, is obtained by subtracting 40 from 76, and 125 is obtained by subtracting 70 from 77. For p=14 case, 126 is obtained by subtracting 37 from 43.

In FIG. 15, the octagons have one concave vertex, and are obtained by subtracting the rhombii of FIG. 4 from the octagons of FIG. 6. Under p=10, 127 and 128 are obtained by removing 59 and 34, respectively, from 75. Similarly, under p=14, 129 is obtained by removing 65 from 43.

Figure 16:
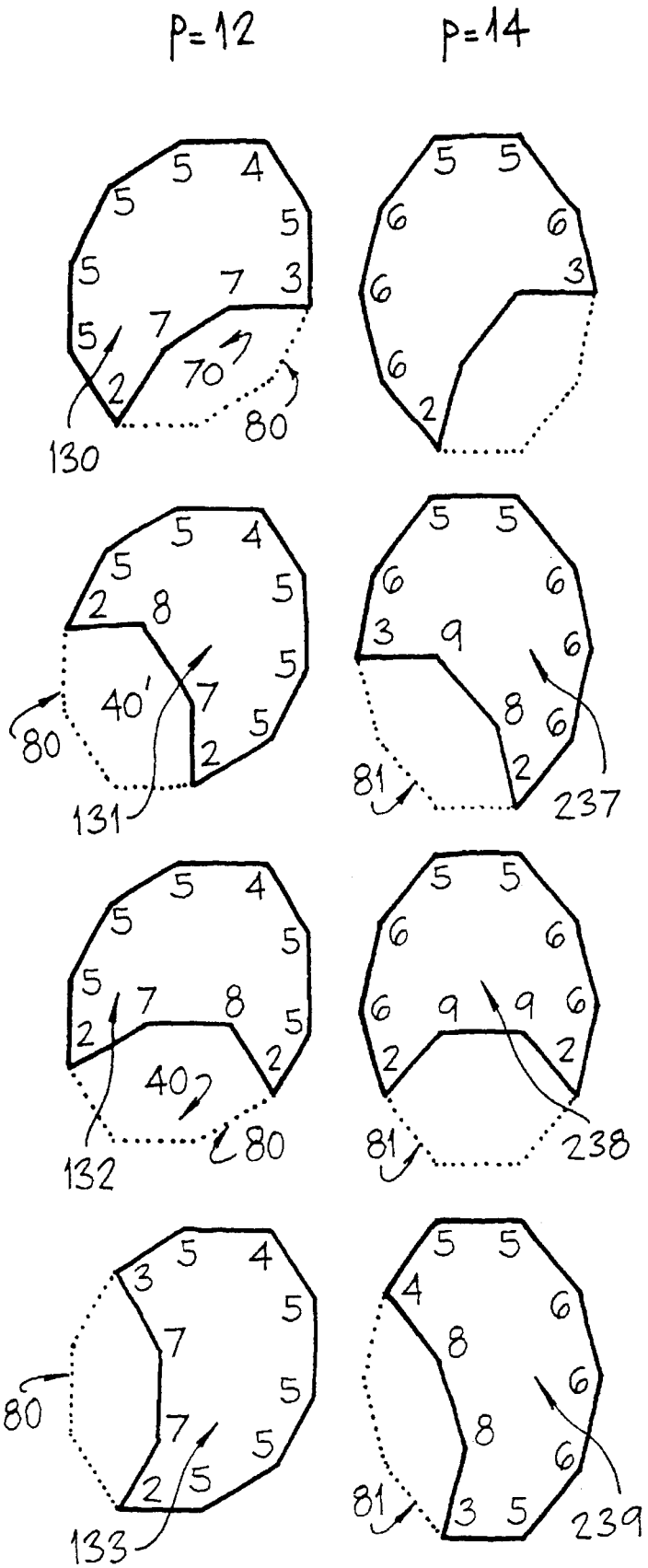
FIG. 16 shows a partial list of singly-concave decagons, p=12 and 14, each having two concave vertices obtained by subtracting a convex hexagon from a convex decagon.

FIG. 16 shows singly-concave decagons, with two concave vertices, obtained by removing convex hexagons of FIG. 6 from the convex decagons of FIG. 7. For example, under p=12 case, the four examples of non-convex decagons 130–133 are derived from the same convex decagon 80. 130 and 133 are obtained by removing 70 and are left- and right-handed. 131 and 132 are obtained by removing 40' and 40 and are also a pair of enantiomorphs.

Figure 17:
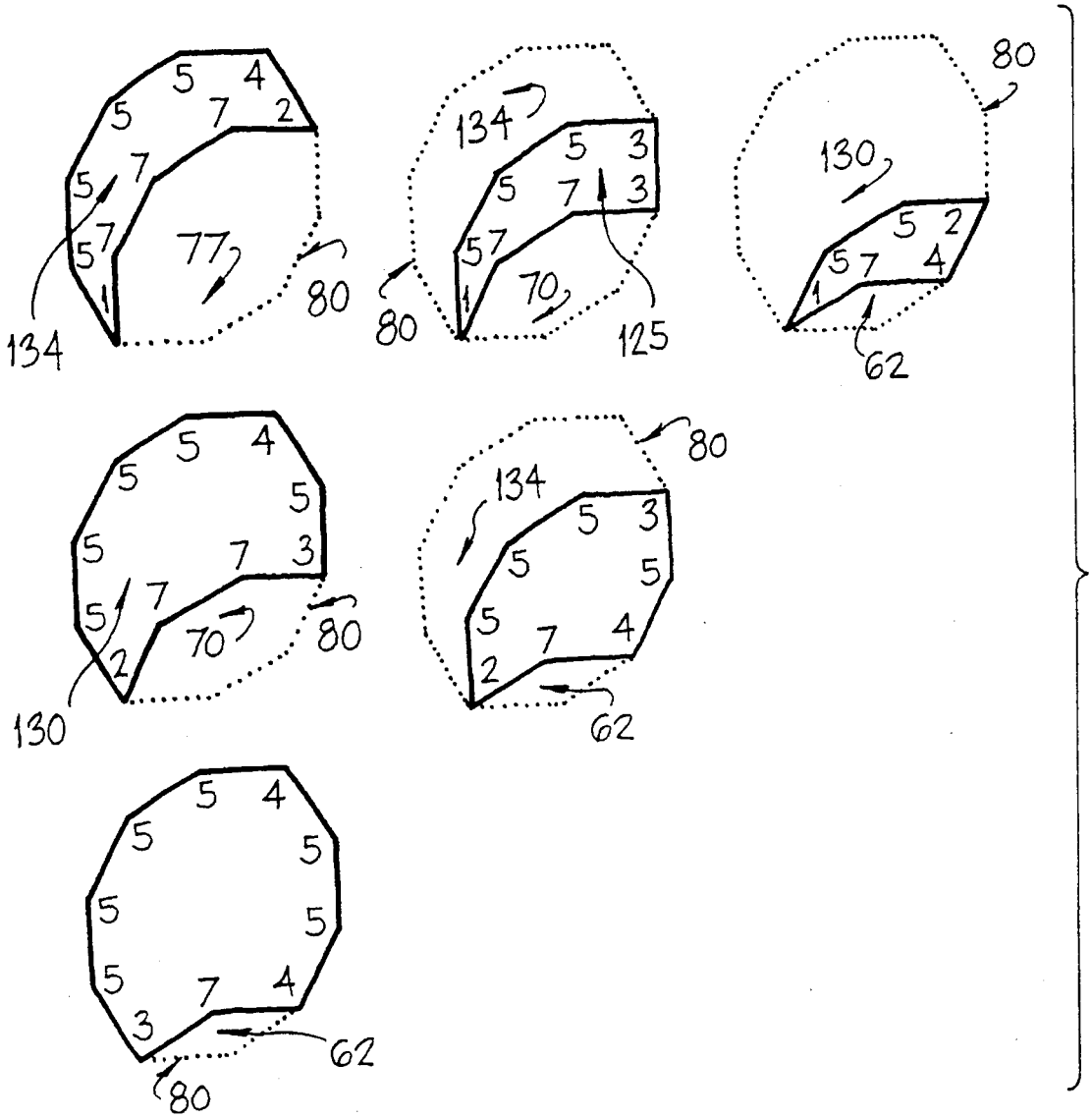
FIGS. 17 and 18 show various singly-concave polygons obtained by removing various convex zonogons from a decagon (p=12) and a dodecagon (p=14), respectively.

FIG. 17 shows various singly-concave polygons for the p=12 case obtained from a single decagon 80. An asymmetric crescent-shaped decagon 134 with three concave vertices is obtained by subtracting the octagon 77, the asymmetric decagon 130 but with two concave vertices is obtained by subtracting the hexagon 70. The asymmetric crescent-shaped octagon 125 is obtained by subtracting the hexagon 70 and the crescent 134 from 80. Other polygons shown are derived in a similar manner.

Figure 18:
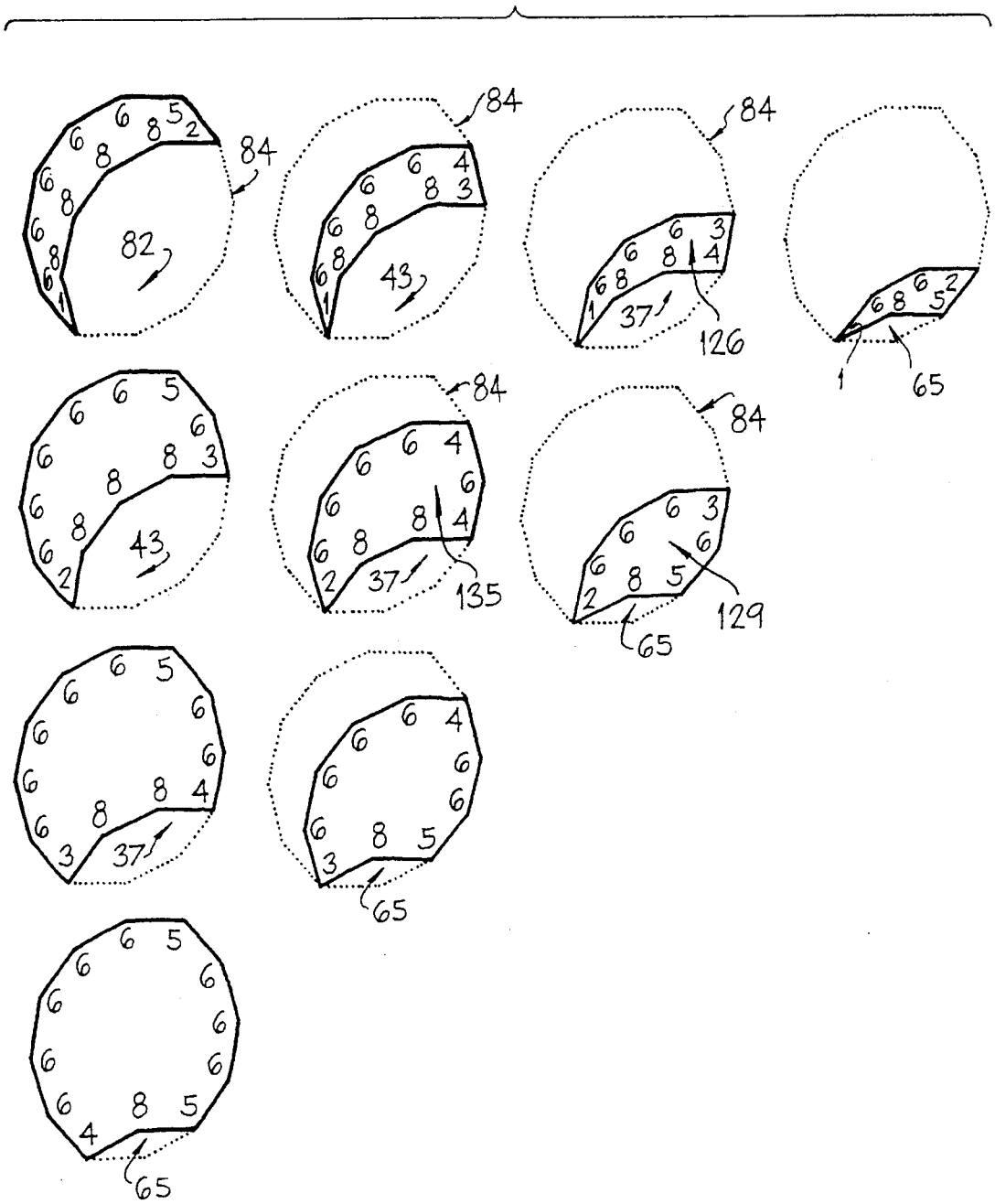

FIG. 18 shows various singly-concave polygons for p=14 case obtained from a single dodecagon 84. The first column shows non-convex dodecagons with four, three, two and one concave vertex obtained by removing the decagon 82, the octagon 43, the hexagon 37 and the rhombus 65, respectively, in the second, third and fourth columns, the removal of the non-convex dodecagons obtained in the first columns is also necessary. Similarly, singly-concave polygons from other zonogons, and from higher values of p, can be derived.

Figure 19:
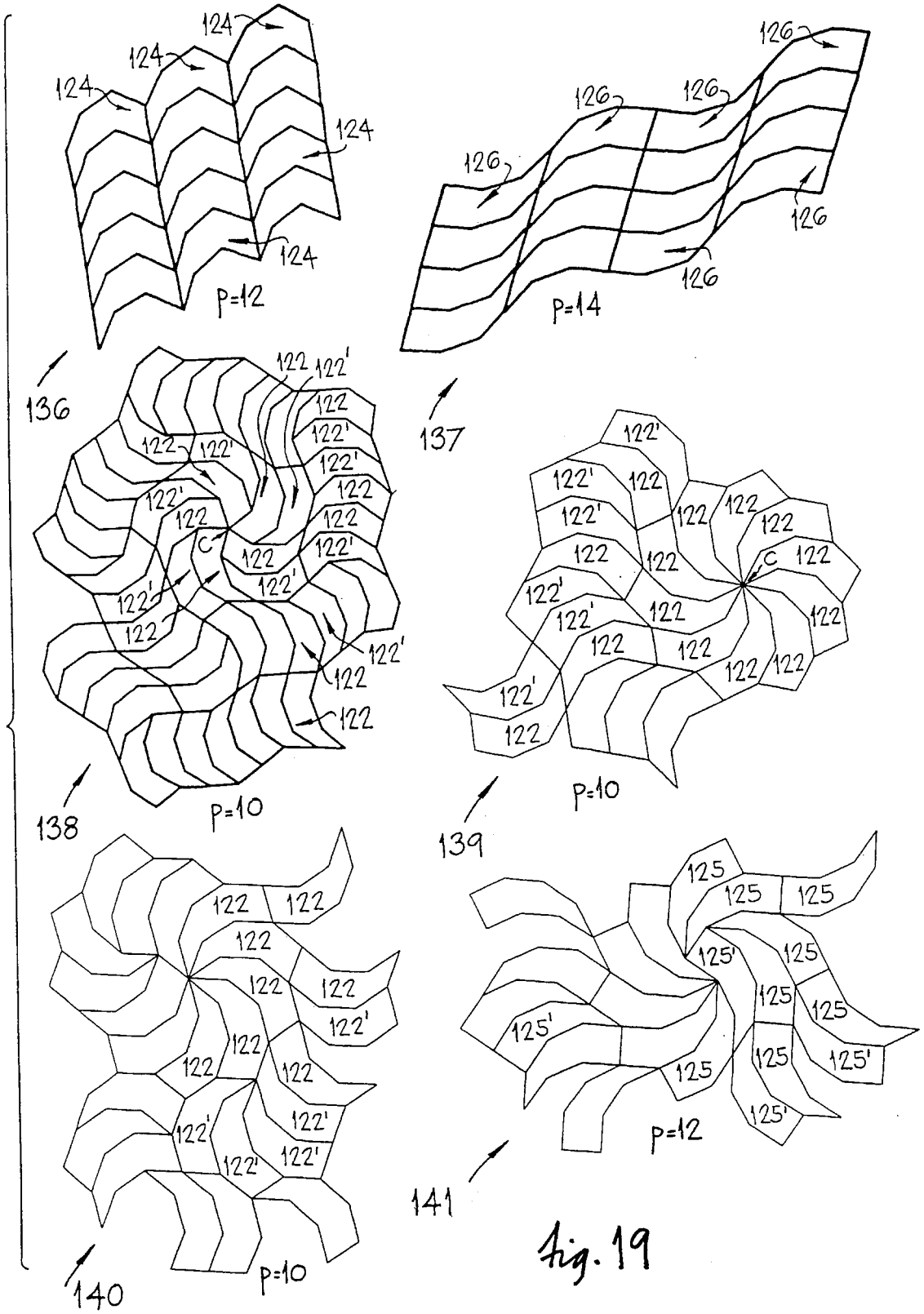
FIG. 19 shows examples of periodic, central and non-periodic tilings using singly-concave octagons with two concave vertices.

FIG. 19 shows various examples of tilings obtained by using a single non-convex tile with two concave vertices. In some cases, right and left-handed tiles are necessary. Tiling 136, p=12, is composed of asymmetric crescents 124 arranged periodically. Tiling 137, p=14, is a periodic arrangement of 126 with a two-fold rotation between adjacent tiles. Tilings 138–140 are all based on p=10 case and use an enantiomorphic pair of asymmetric crescents 122 and 122': tiling 138 has a central 5-fold rotational symmetry around the center C, tiling 139 has a 10-fold rotational symmetry around C, and 140 is non-periodic. Tiling 141, p=12, is also non-periodic and is composed of right- and left-handed pairs 125 and 125'.

Figure 20:
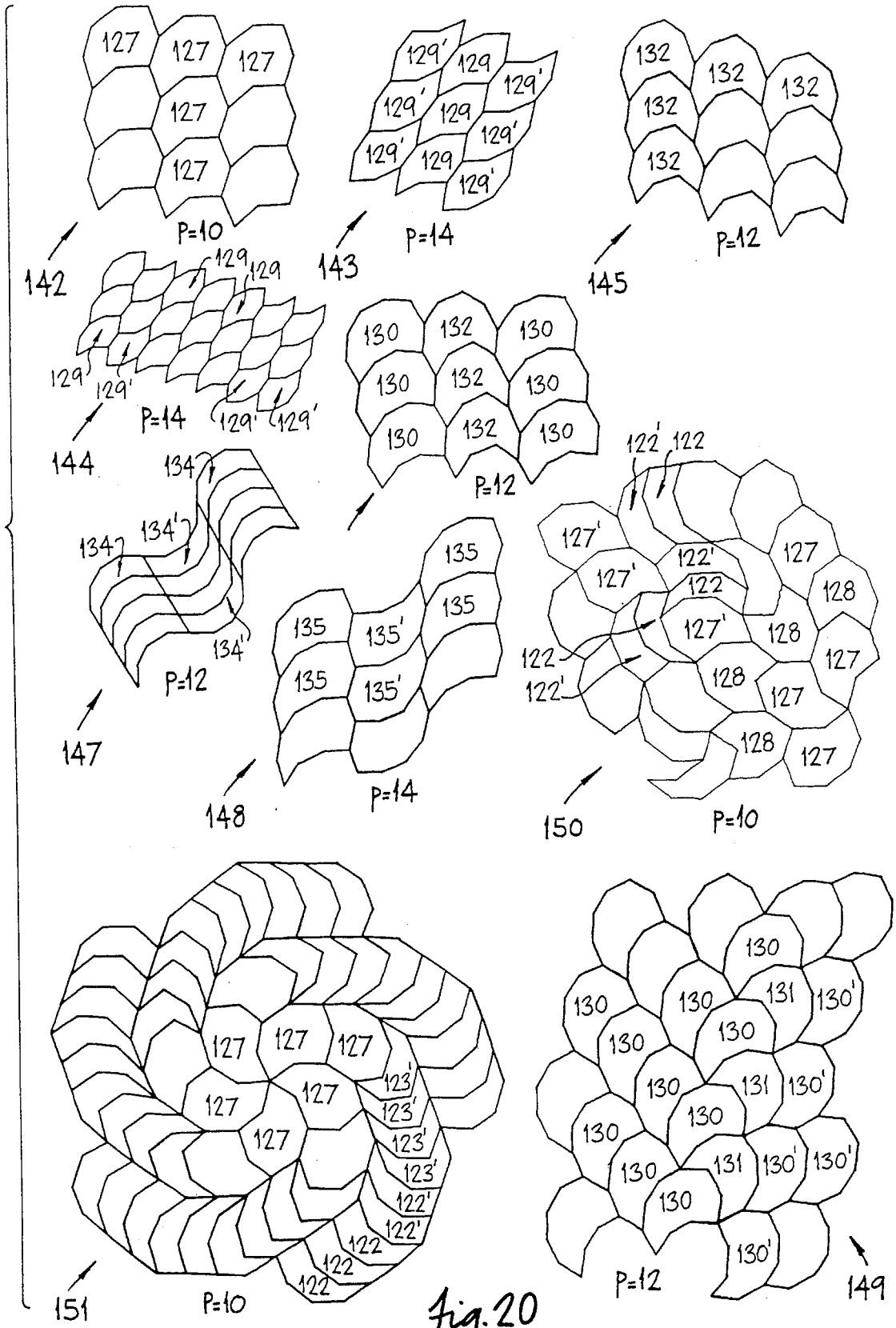
FIG. 20 shows examples of periodic, central and non-periodic tilings composed of various singly-concave polygons, some in combination with others.

FIG. 20 shows various examples of tilings composed of singly-convex tiles with one, two and three concave vertices, and some composed of a combination of tiles with one and two concave vertices. Tiling 142, p=10, is a periodic tiling using the octagon 127 having one inverted vertex. Tiling 143, p=14, is a periodic tiling with left- and right-handed octagons 129' and 129, Tilling 144, p=10, is a non-periodic variant of 143. Tiling 145 is a periodic tiling with a decagon having two inverted vertices. Tiling 146, p=12, is composed of two different decagonal tiles 130 and 132, and can be periodic or non-periodic. Tiling 147, p=12, is a periodic tiling using asymmetric decagonal crescents 134 and 134' (right- and left-handed versions) with a two-fold rotational symmetry between adjacent tiles. Tiling 148, p=14, is similar to 143 and 147, and is composed of left- and right-handed tiles 135 and 135'. Tiling 149, p=12, is a non-periodic tiling composed of decagons 130, 130' and 131. Tiling 150, p=10, is a non-periodic tiling composed of tiles 127, 127', 128, 122 and 122'. Tiling 151, p=10, has a central 5-fold symmetry and is composed of tiles 122, 122', 123, 123' and 127.

FIGS. 21–25 show two classes of doubly-concave polygons with a 2-fold symmetry. Such tiles have a rotational symmetry in most cases though some are mirror-symmetric. They are derived from convex zonogons by removing smaller (with fewer sides) zonogons from two opposite sides.

Figure 21:
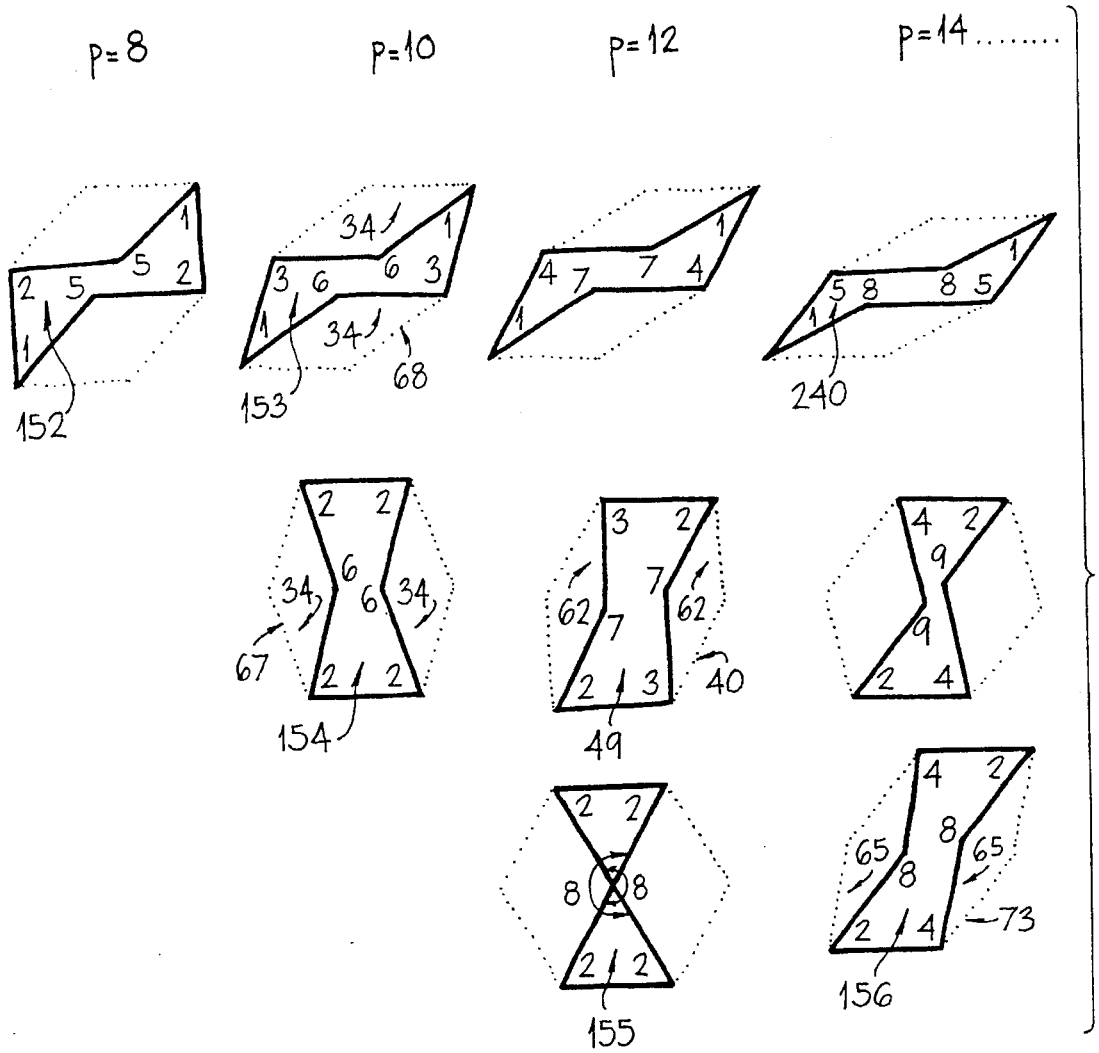
FIG. 21 shows a partial list of bi-concave hexagons with a 2-fold symmetry and two concave vertices obtained by removing two rhombii from the opposite vertices of convex hexagons

FIG. 21 shows bi-concave hexagons obtained by removing rhombii of FIG. 4 from the hexagons of FIG. 5. For example, under p=10, the non-convex hexagon 153 is derived by removing a pair of rhombii 34 from the hexagon 68, and 154 is obtained by removing a pair of 34 from 67. Note that 153 has a rotational symmetry and 154 has a mirror symmetry. Similarly, for p=12, 49 is derived by removing 62 from the opposite ends of 40, and for p=14, 156 is derived by removing 65 from 73.

Figure 22:
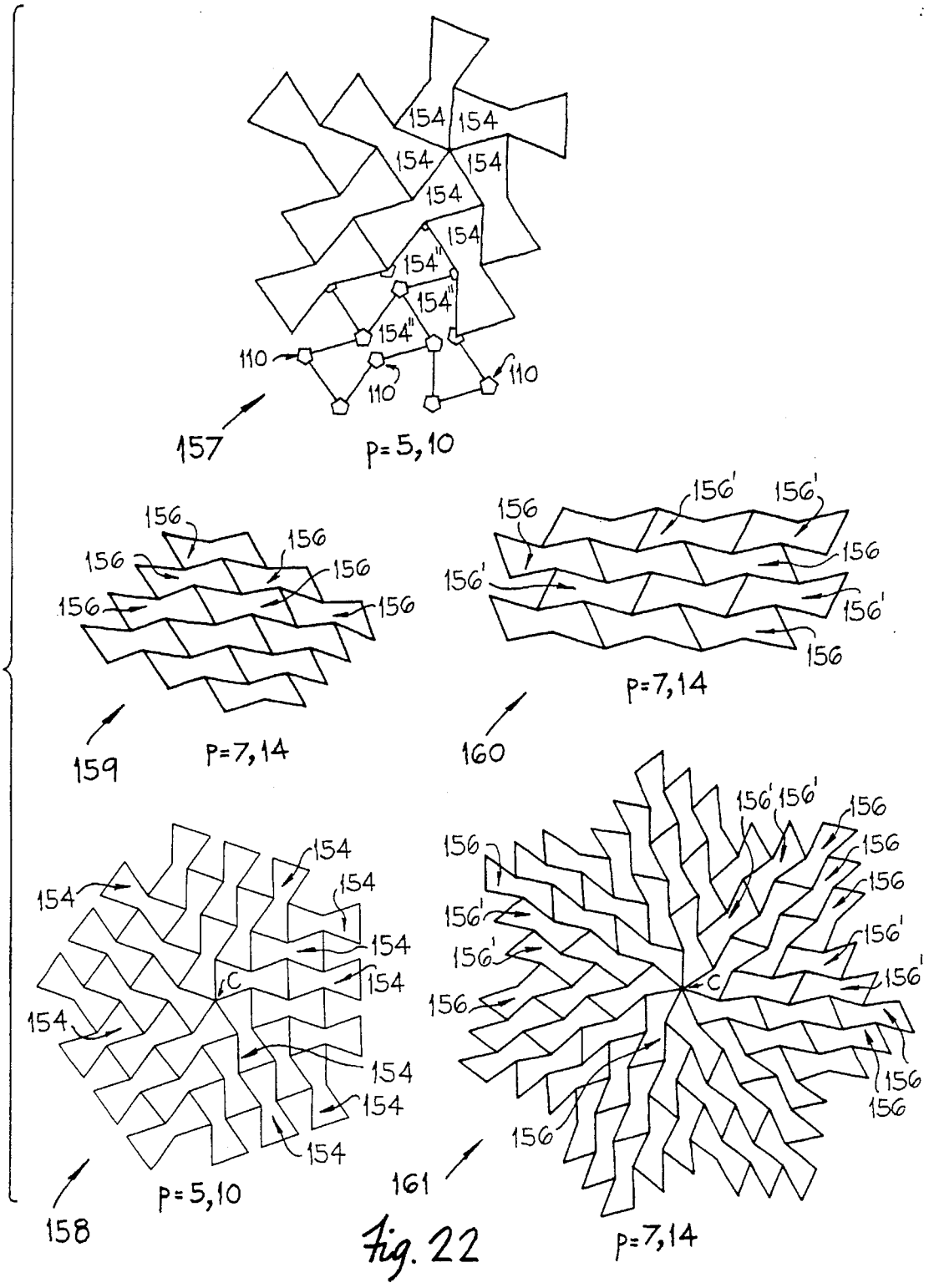
FIG. 22 shows examples of periodic, central and non-periodic tilings with bi-concave hexagons.

FIG. 22 shows various tilings using bi-concave hexagons. The tilings 157 and 158, p=5 or 10 cases, are similar and are composed of 154. Tiling 157 also shows the pentagonal nodes 110, and variant tiles 154" with cut-outs at the corners to accomodate the nodes; it is based on FIG. 10 of the parent application. Tiling 158 shows a 5-fold arrangement with central symmetry around C. Tilings 159 and 160, both p=7 or 14 cases, are periodic patterns using 156. Tiling 161, p=7 or 10, has a central 7-fold symmetry around C and is composed of 156.

Figure 23:
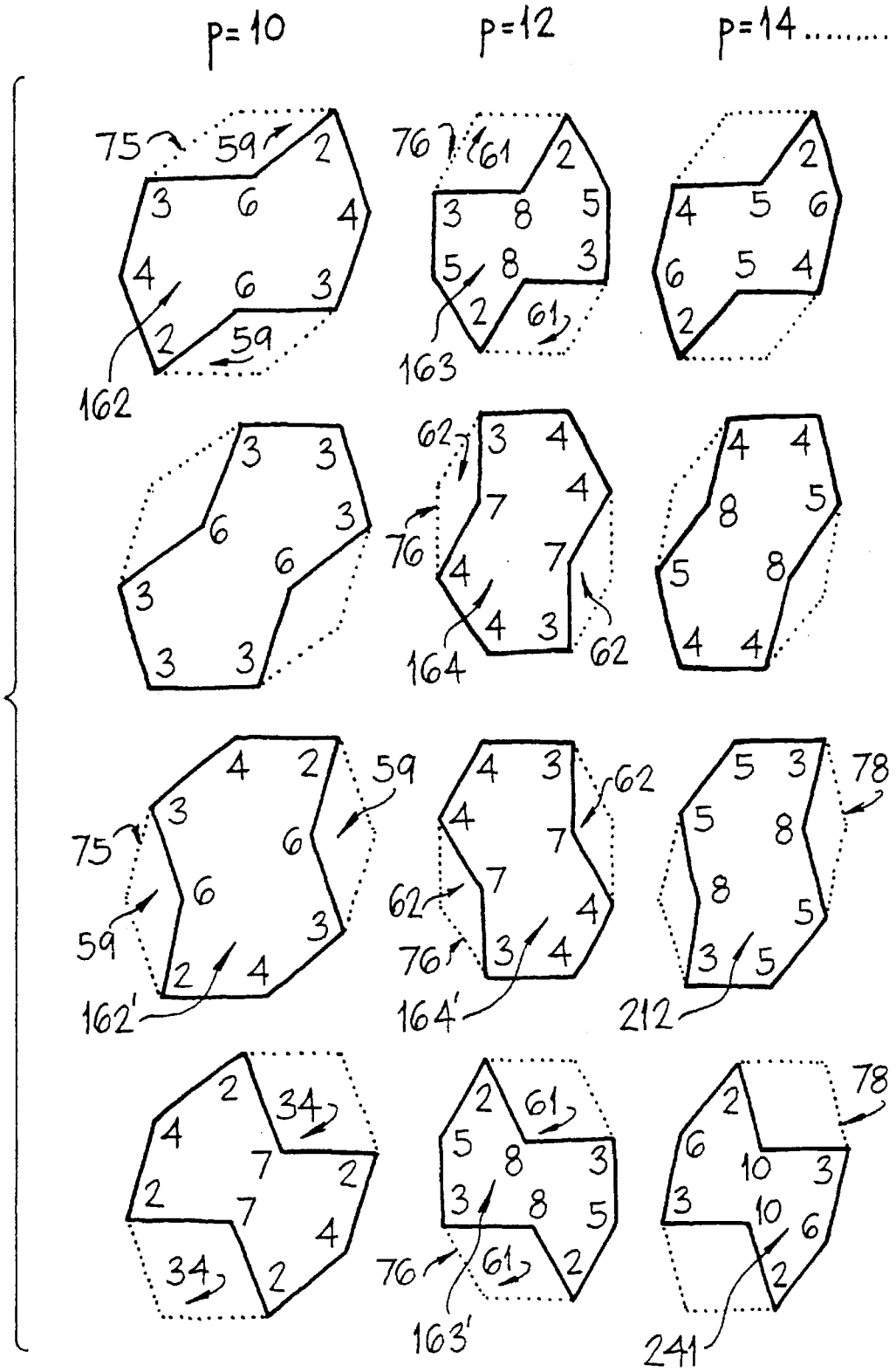
FIG. 23 shows a partial list of bi-concave octagons with a 2-fold symmetry and two concave vertices obtained by removing two rhombii from the opposite sides of a convex octagon.

FIG. 23 shows bi-concave octagons obtained by removing two rhombii of FIG. 4 from the opposite ends of octagons of FIG. 6. As in the case of bi-concave hexagons, all bi-concave octagons here have a two-fold symmetry. Most of them possess a rotational symmetry while some have a mirror symmetry. The sum of angle-numbers equals 3p. For each value of p, the various bi-concave octagons from the same convex octagons are shown. The octagons 162 and 162', p=10, are right- and left-handed versions obtained by removing a pair of rhombii 59 from a different pair of opposite ends of the convex octagon 75, in the p=12 case, the octagons 163 and 164 are obtained by removing pairs of 61 and 62 from 76; for each there exists an enantiomorph 163' and 164' as shown.

Figure 24:
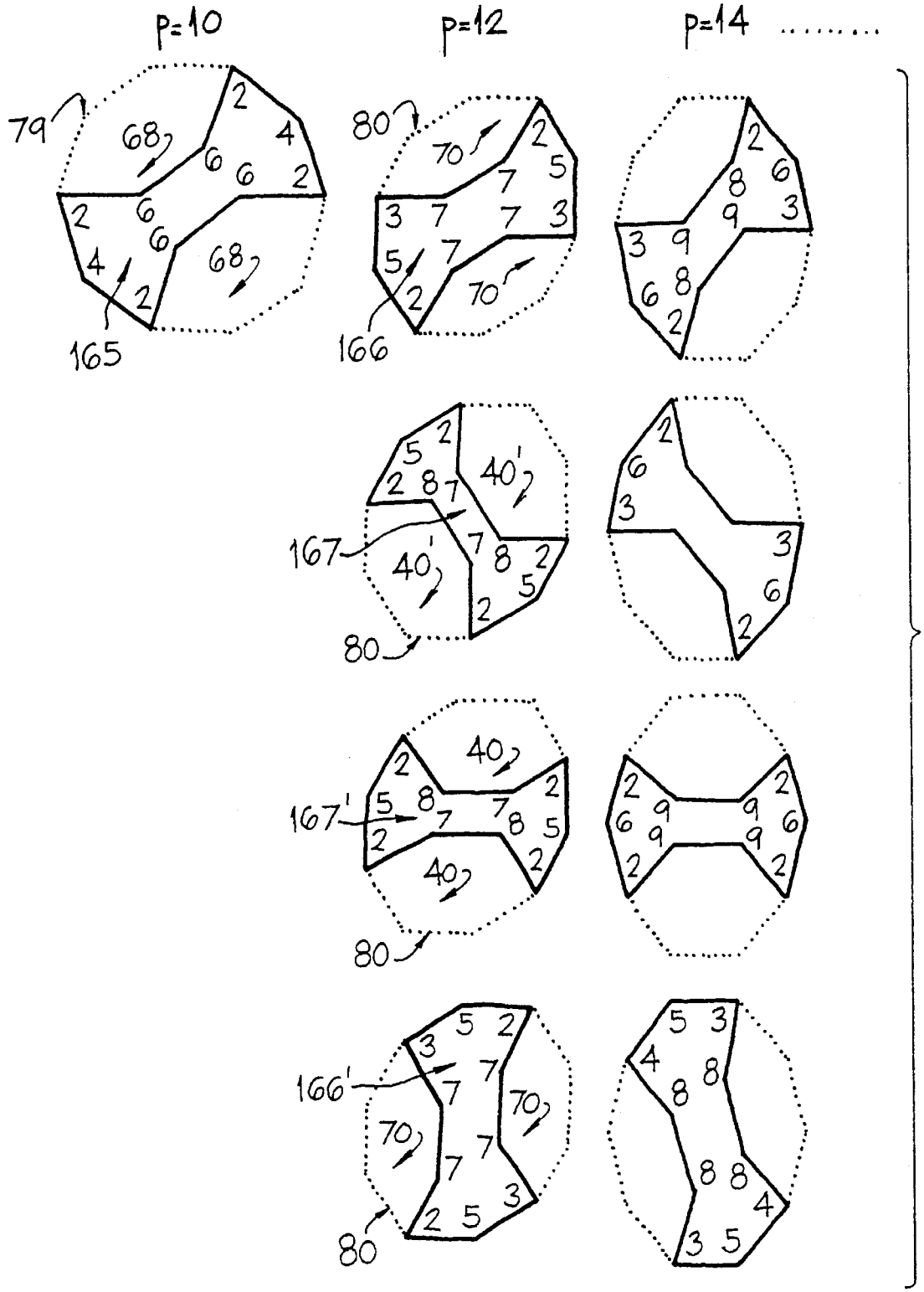
FIG. 24 shows a partial list of bi-concave decagons with a 2-fold symmetry and four concave vertices obtained by removing two hexagons from the opposite sides of a convex decagon.

FIG. 24 shows bi-concave decagons with a two-fold symmetry obtained by removing a pair of convex hexagons of FIG. 5 from the opposite sides of the convex decagons of FIG. 7. Here too, most examples have a rotational symmetry though some are mirror-symmetric. In each case, two opposite vertices are concave. The sum of the angle numbers in each equal 4p. The decagon 165, p=10, is derived by subtracting a pair of 68 from the regular decagon 79. The decagons 166 and 167, p=12, are derived by subtracting the hexagons 70 and 40 from 80 as shown; both have their enantiomorphs 166' and 167'.

Figure 25:
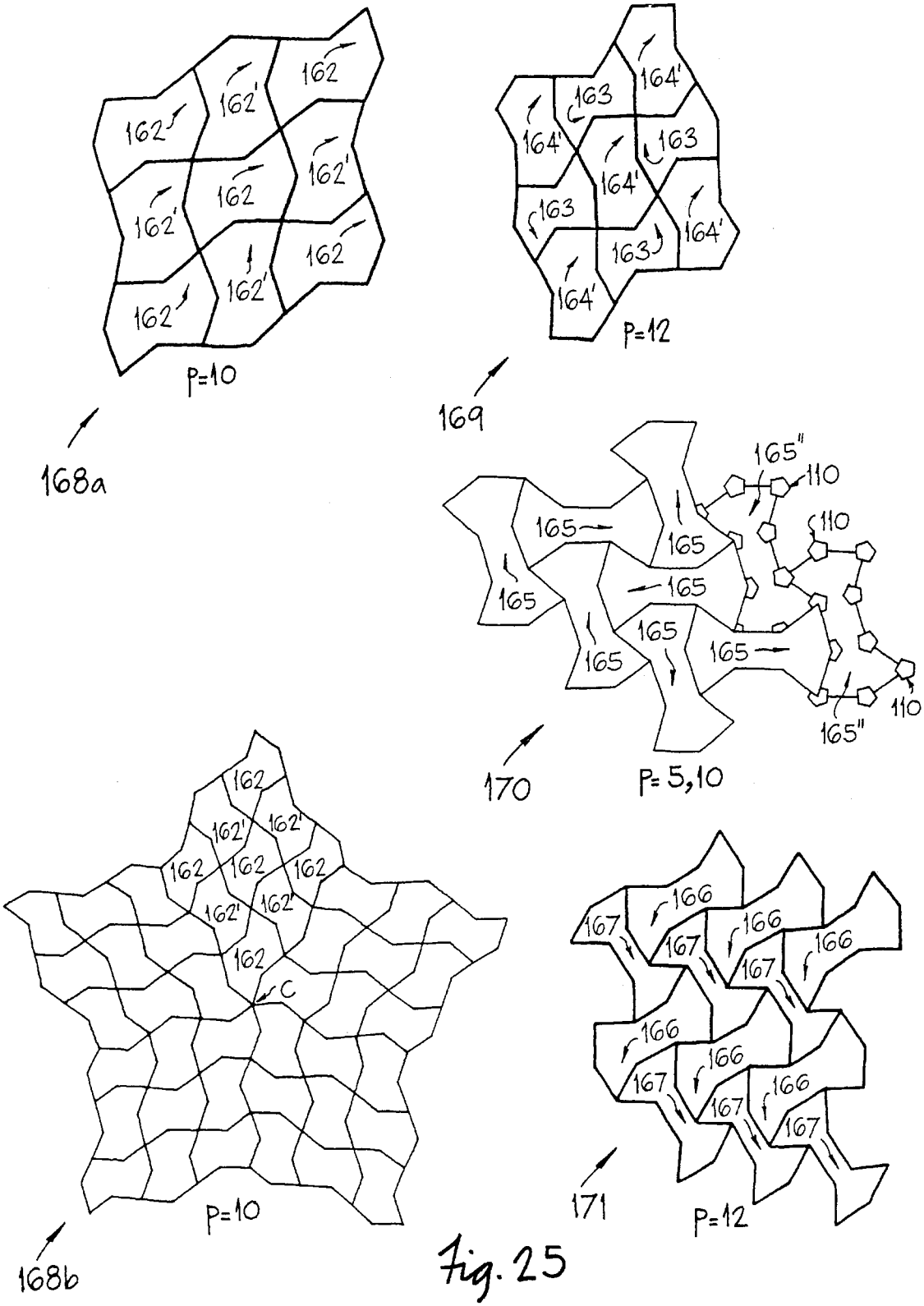
FIG. 25 shows examples of periodic and central tilings composed of bi-concave decagons with 2-fold symmetry.

FIG. 25 shows examples of tilings with bi-concave polygons of FIGS. 23 and 24. Tiling 168a, p=10, is periodic and is composed of left- and right-handed octagons 162 and 162'. Tiling 168*b*, p=10, is composed of 162 and 162' and has a central 5-fold symmetry around C. The nine tiles which are shown numbered are identical to the tiling 168. Tiling 169, p=12, is also periodic, but is composed of two different octagons 163 and 164'. Tiling 170, p=5 or 10, is composed of bi-concave decagons 165 arranged periodically. It has pentagonal nodes 110, and the infill tiles 165" are variants of 165; this tiling is based on FIG. 2 of the parent application. Tiling 171, p=12, is composed of two different bi-concave decagons 166 and 167, also arranged periodically.

Figure 26:
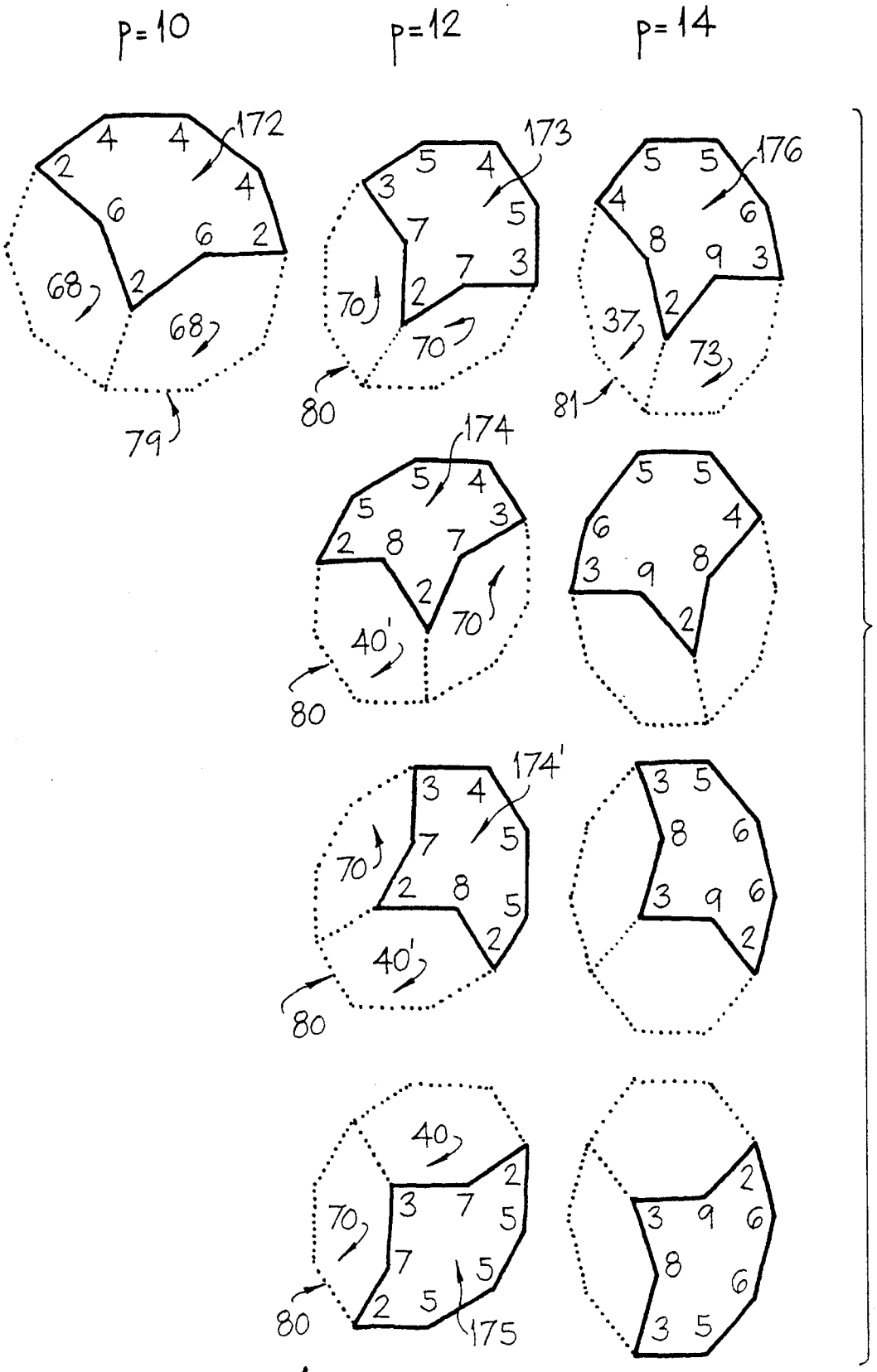
FIG. 26 shows a partial list of different types of bi-concave octagons with two concave vertices, each either asymmetric or having a bilateral symmetry, and obtained by subtracting two adjacent hexagons from a decagon.

FIG. 26 shows a different class of bi-concave octagons obtained by removing two hexagons of FIG. 5 from the decagons of FIG. 7. The hexagons which are removed are adjacent to each other, thus resulting in either an asymmetrical or a bilaterally symmetric polygon. Compare FIG. 26 with FIG. 24: in both figures, two hexagons are removed, but the results are completely different. Here, each octagon has two concave vertices, and the sum of angle numbers equals 3p. The octagon 172, p=10, is obtained by removing a pair of 68 from 79. The four octagons under p=12 are obtained by removing a pair of hexagons from the same decagon 80. 173 is obtained by removing a pair of 70, 174 and 174' are an enantiomorphic pair obtained by removing 40' and 70, and 175 is obtained by removing 40 and 70. The octagon 176, p=14, is obtained by removing 37 and 73 from 81.

FIG. 27 show two examples of asymmetric bi-concave decagons obtained by removing two different types of zonogons from a larger zonogon. Decagons 177 and 177', a left- and right-handed pair based on p=14, are obtained by removing two different zonogons from the dodecagon 84 of FIG. 8. 177 is obtained by removing 73' (the mirror image of 73, FIG. 5) and 43, and 177' is obtained by removing 78' (the mirror image of 78, FIG. 6) and 37 of FIG. 5. The sum of angle numbers in such bi-concave decagons equals 4p.

FIG. 28 shows four examples of tilings using bilaterally symmetric or asymmetric bi-concave polygons. Tiling 178, p=5 or 10, is composed of 172 in a non-periodic arrangement and is based on FIG. 7 of the parent application. The pentagonal nodes 110 surround the tile 172", a variant of 172 obtained by modifying the corners of the tile to receive the pentagonal node-tile. Tiling 179, p=14, is a periodic tiling composed of 176. Tiling 180, p=12, is also periodic and is composed of 175 and 174'. Tiling 181, p=14, is a periodic tiling composed of 177.

Figure 29:
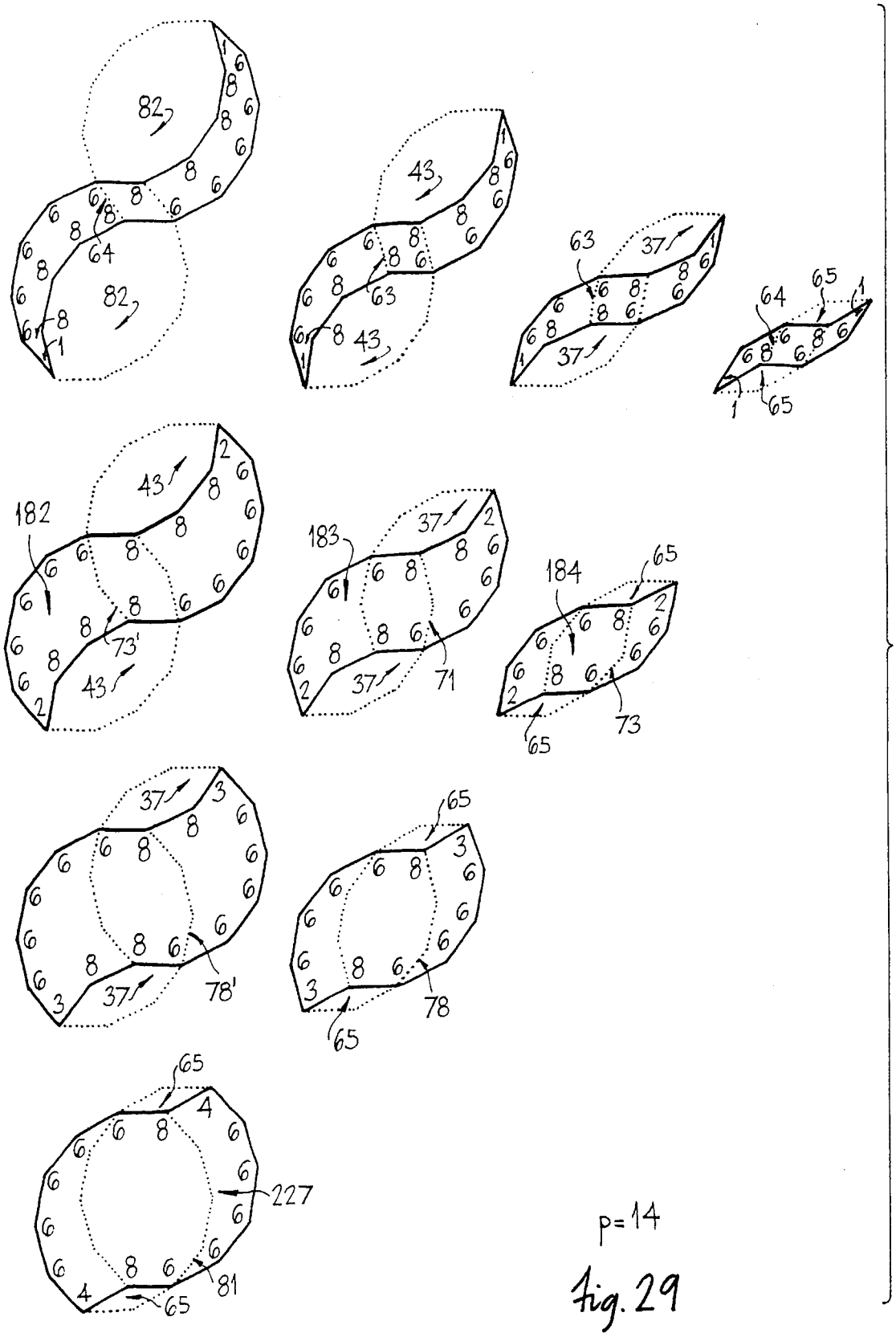
FIG. 29 shows a class of S-shaped polygonal tiles for p=14.

FIG. 29 shows a class of S-shaped tiles obtained by fusing two identical singly-concave tiles in a two-fold rotational symmetry around a central tile. The central tile is a convex zonogon obtained by overlapping the ends of the two tiles being fused. The tiles in FIG. 29 are shown for the p=14 case, and result from fusing two identical singly-concave tiles of FIG. 18. In FIGS. 29 and 18, the related tiles are shown in corresponding positions. For example, the S-shaped tile 183 is obtained by fusing two tiles 135 of FIG. 18 around the central hexagon 71 obtained by the overlap of the two tiles in a 2-fold rotational symmetry. The location of the two empty hexagons 37 on the opposite sides of the S-shaped tile shows the 2-fold symmetry. Similarly, the S-shape tile 184 is obtained by overlapping and fusing two tiles 129 of FIG. 18 around the central hexagon 73. The other S-shaped tiles can be derived similarly.

Figure 30:
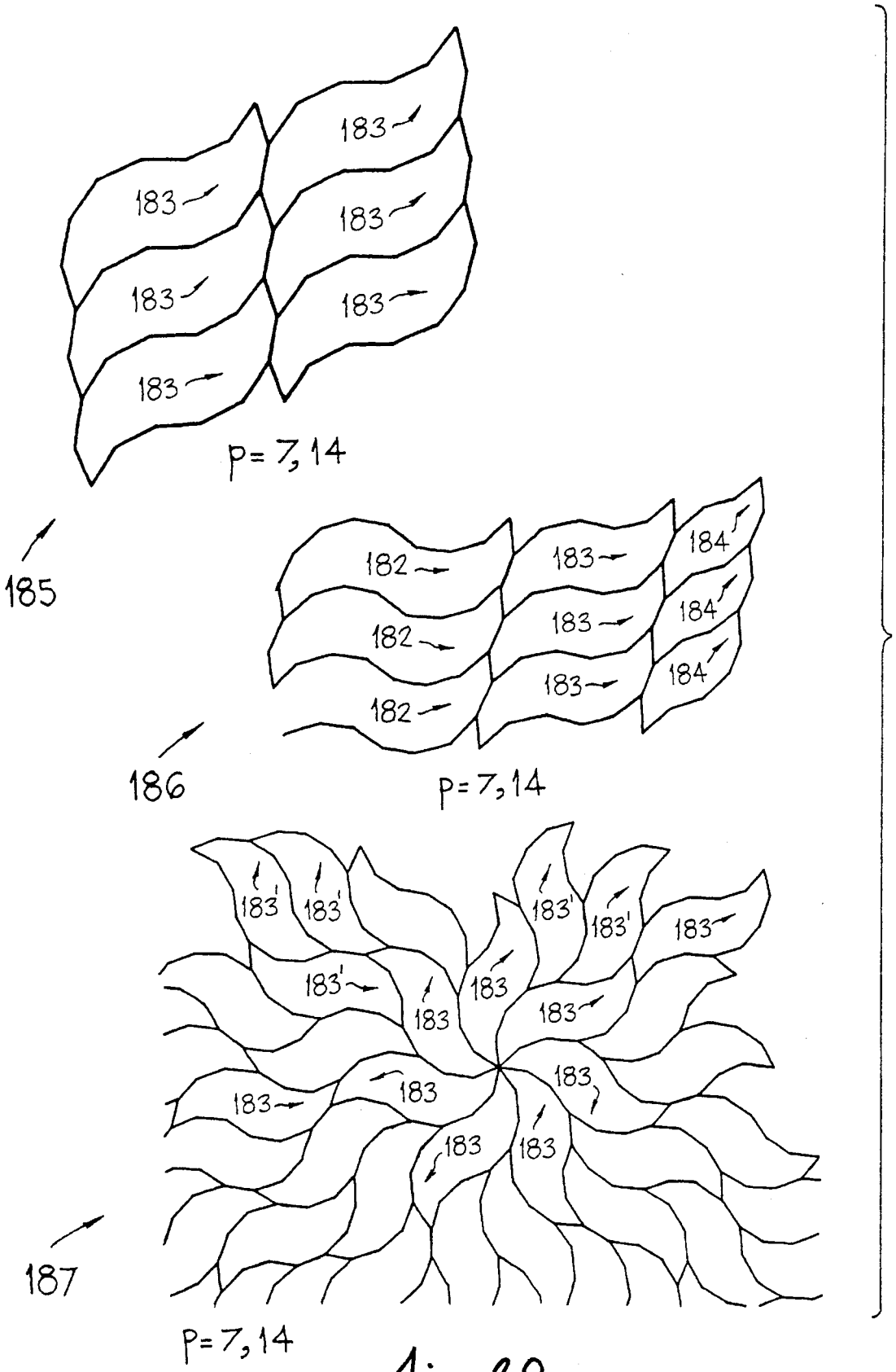
FIG. 30 shows tilings composed of S-shaped tiles.

FIG. 30 shows three examples of tilings with S-shaped tiles. Tiling 185, p=7 or 14, is a periodic tiling with tiles 183. Tiling 186 is composed of three different tiles, 182, 183 and 184. The three can be repeated periodically or alternated non-periodically. Tiling 187 is a tiling with central 7-fold symmetry and uses right- and left-handed S-shaped tiles 183 and 183'. It can be derived from p=7 or 14 nodes.

Figure 31:
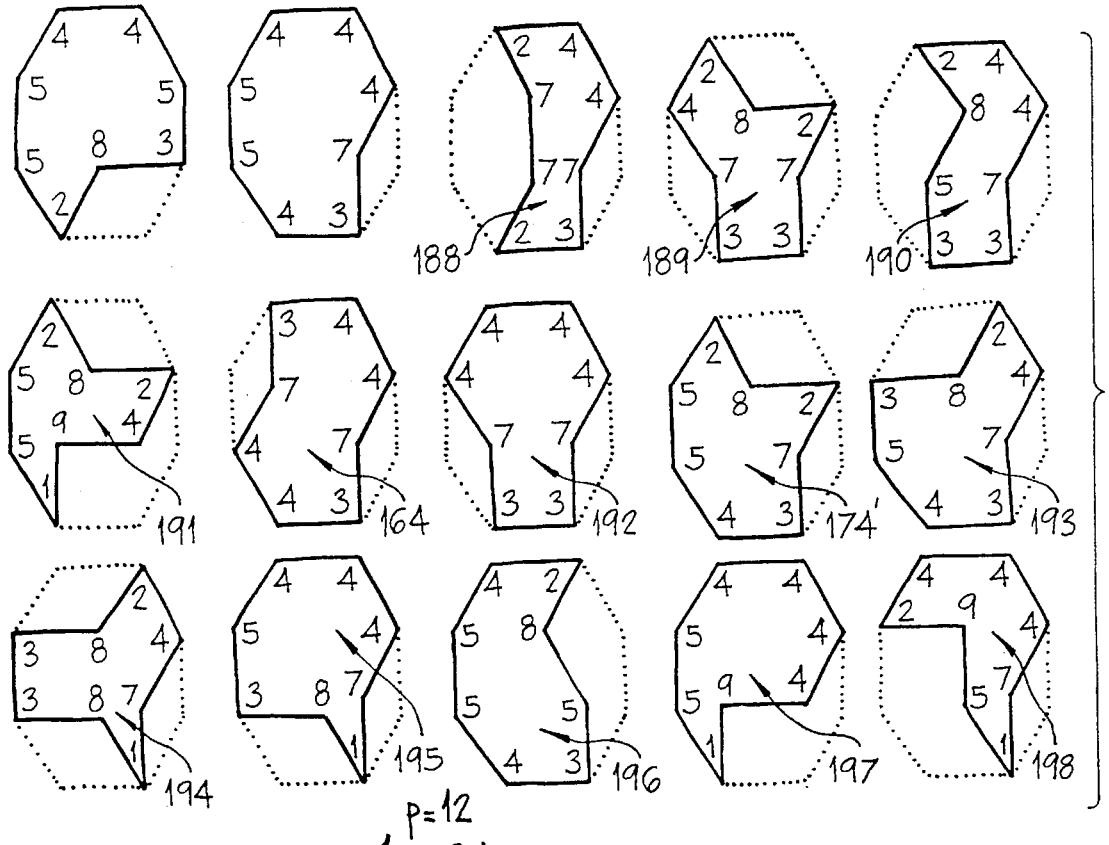
FIG. 31 shows an assortment of various tile shapes by subtracting rhombii and convex or singly-concave hexagons from an octagon of p=12.

FIG. 31 shows an assortment of non-convex polygons obtained from the octagon 76, p=12, by removing any combination of convex and non-convex polygons. The top two are singly-concave octagons by removing rhombii, and are identical to those shown in FIG. 15. The five polygons, namely, 164 (seen earlier in FIG. 23), 192, 174' (also seen earlier in FIG. 26), 193, 195 are doubly-concave octagons by removing two rhombii. 188 is obtained by removing a hexagon and a rhombus. 196 and 197 are obtained by removing a singly-concave hexagon. 190, 191, and 198 are obtained by removing a singly-concave hexagon and a rhombus. 189 and 194 are tri-concave obtained by removing three different rhombii. The latter have three concave vertices. Other non-convex polygons can be similarly derived from other zonogons based on different values of p.

Figure 32:
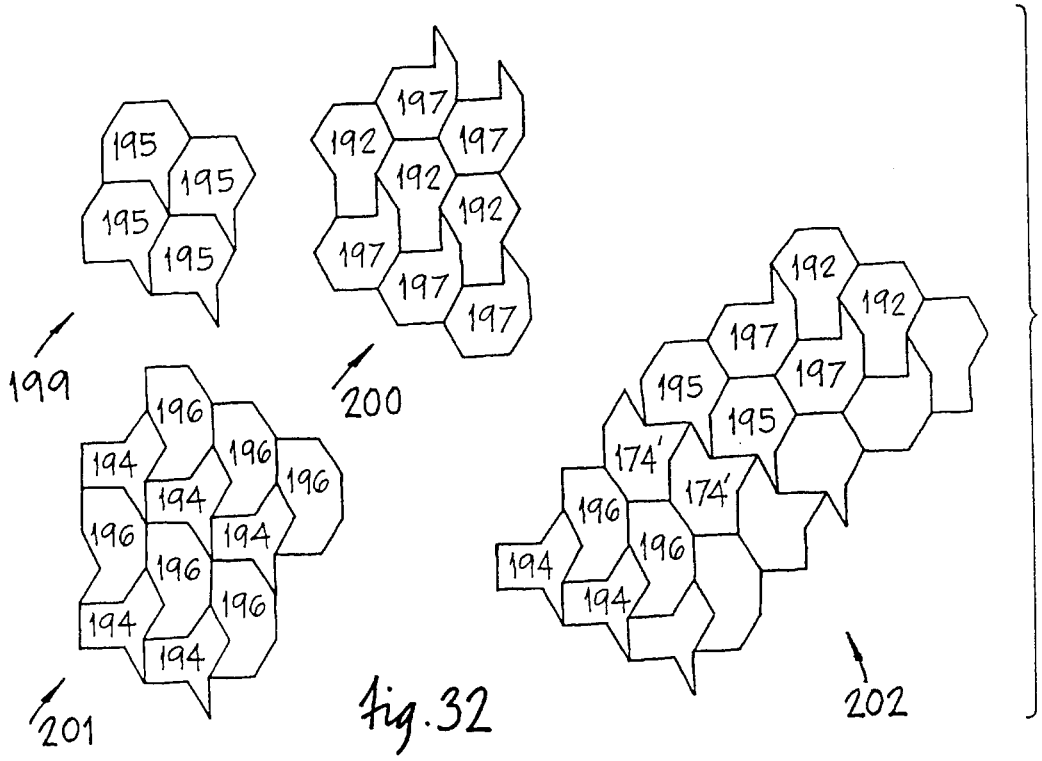
FIG. 32 shows examples of tilings using tiles from FIG. 31.

FIG. 32 shows examples of tilings composed of tiles from FIG. 31. Tiling 199 is a periodic tiling with 195. Tiling 200 is also a periodic tiling composed of 192 and 197. Tiling 201 is another periodic tiling composed of 194 and 196. Tiling 202 is a mixed tiling of six different tiles, 194, 196, 174', 195, 197 and 192. This particular tiling can be converted into a periodic or a non-periodic tiling by alternating successive pair of rows of tilings in a repeating or non-repeating manner.

Figure 33:
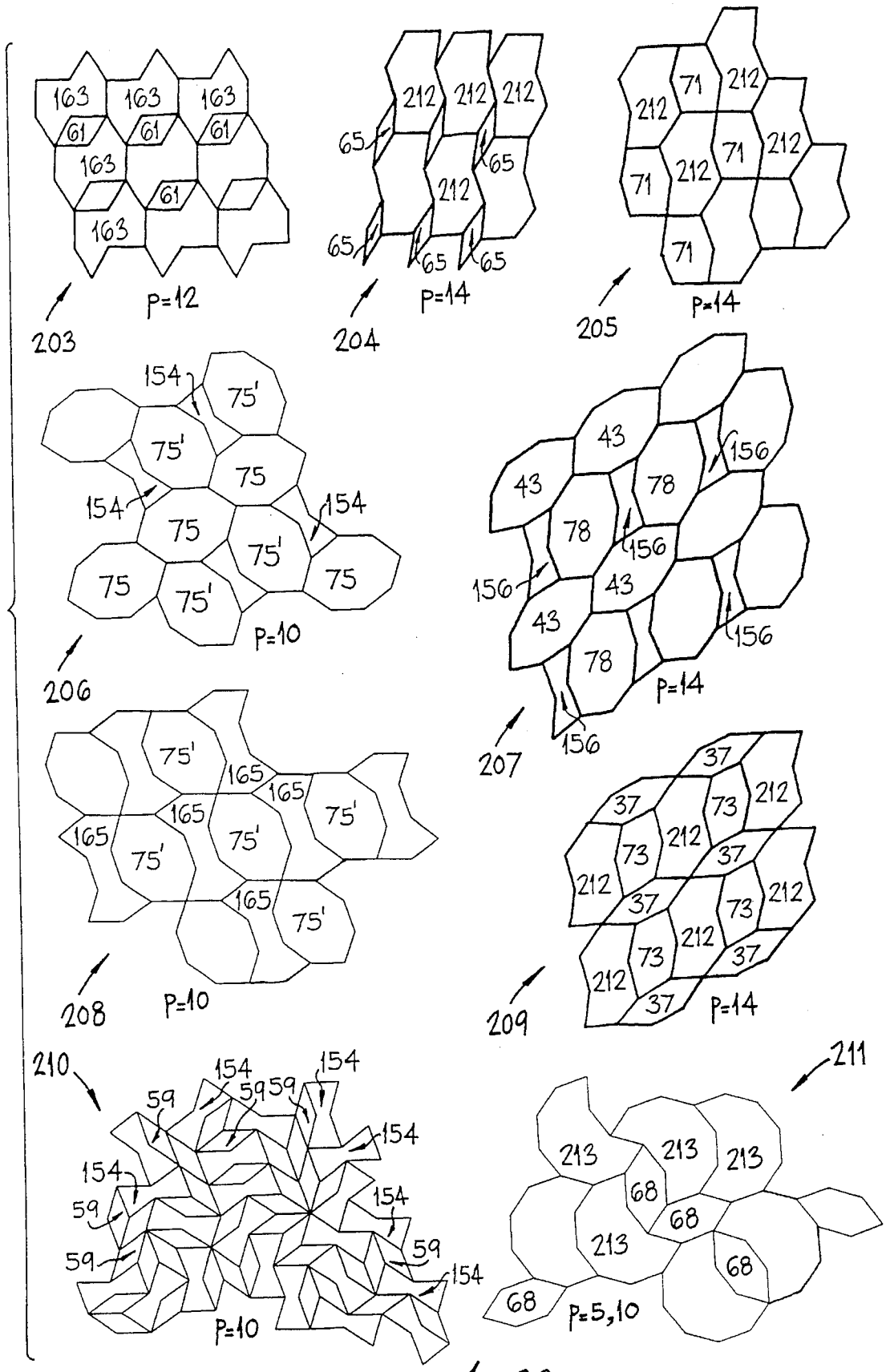
FIG. 33 shows examples of periodic and non-periodic tilings which combine convex and non-convex polygons.
Figure 34:
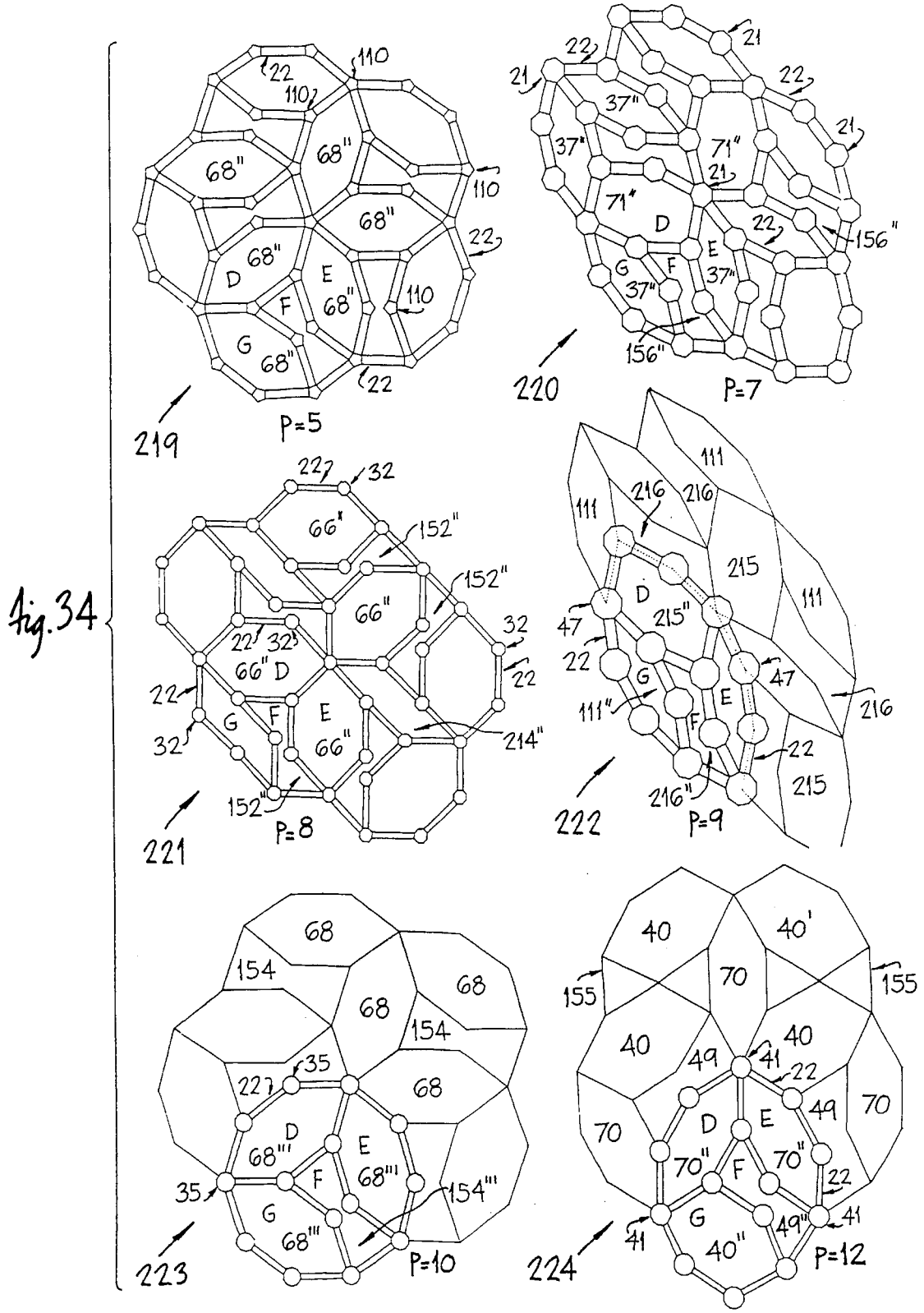
FIG. 34 shows topologically identical non-periodic tilings composed of node-tiles, strut-tiles and infill-tiles derived from various p-sided polygonal nodes.
Figure 35:
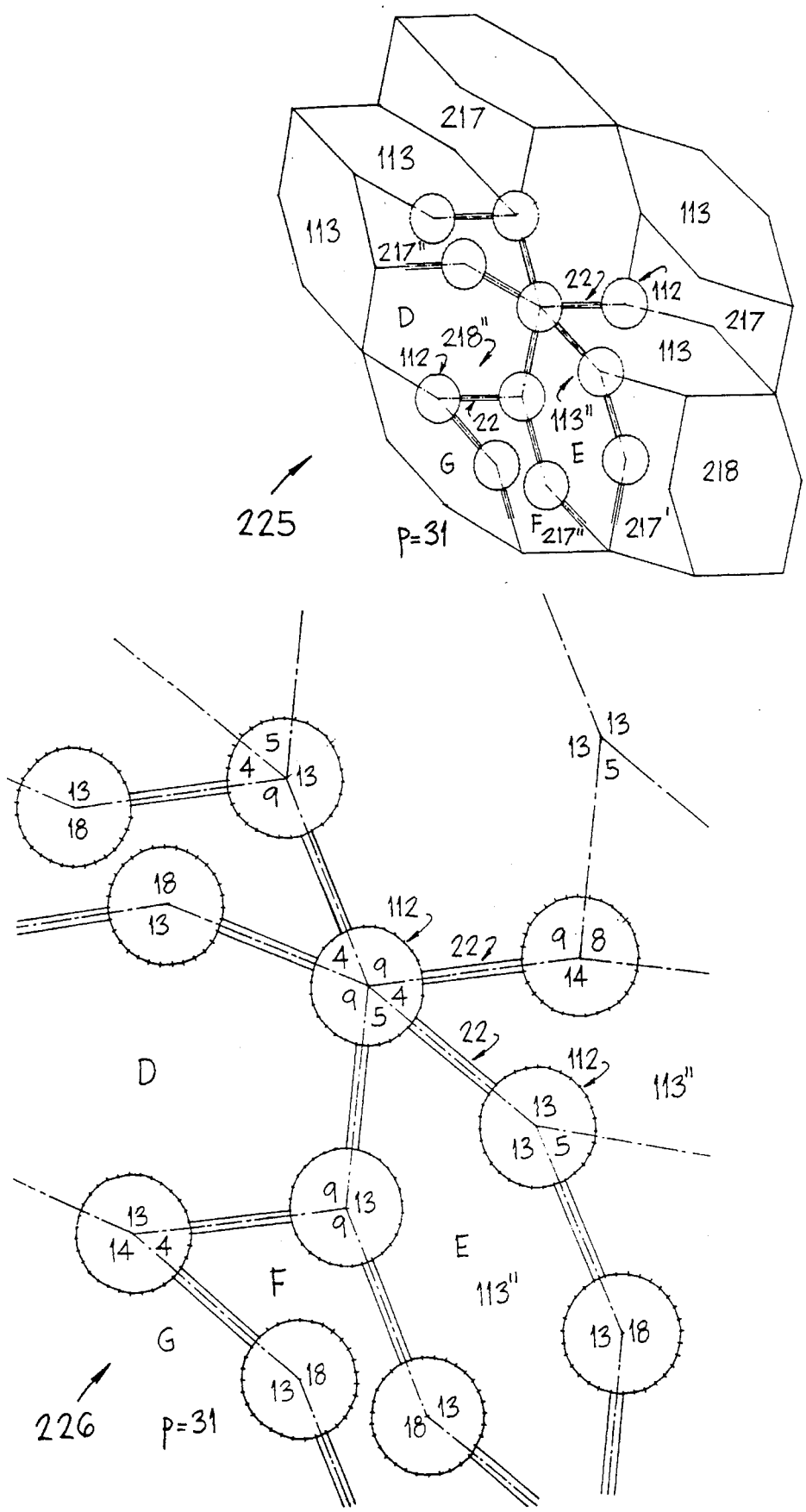
FIG. 35 shows a non-periodic tiling, also topologically isomorphic with the examples in FIG. 34, based on p=31-sided nodes.

The examples of tilings shown so far have been composed of either convex tiles or non-convex tiles. FIGS. 33–35 show examples of tilings which combine both convex and non-convex tiles in one tiling configuration.

FIG. 33 shows seven examples of periodic tilings 203–209, and two examples of non-periodic tilings 210 and 211. Tiling 203, p=12, is composed of bi-concave octagons 163 and rhombii 6i. Tiling 204, p=14, is composed of bi-concave octagons 212 and rhombii 65. Tiling 205, also p=14, is composed of bi-concave octagons 212 and convex hexagons 71. Tiling 206, p=10, is composed of convex octagons 75 and 75' (mirror image of 75) and bi-concave hexagon 154. Tiling 207, p=14, is composed of two different convex octagons 78 and 43, and bi-concave hexagon 156. Tiling 208, p=10, is composed of convex octagons 75' and bi-concave decagons 165. Tiling 209, p=14, is composed of bi-concave octagons 212, and two convex hexagons, 37 and 73. Tiling 210, p=10, is composed of bi-concave hexagons 154 and rhombii 59. Tiling 211, p=5 or 10, is composed of singly-concave tile 213 and convex hexagons 68; the tile 213 is crescent-shaped and is obtained by removing the hexagon 63 from the regular decagon 79.

FIG. 34 shows six examples of portions of non-periodic tilings composed of various polygonal node-tiles, rectangular strut tiles 22 and infill tiles which are variants of convex and non-convex hexagons. The center lines of the strut-tiles define the convex and non-convex hexagons. in all six examples, the tiling patterns are toplogically identical. This can be visually verified by looking at the areas marked D, E, F and G in each tiling. These areas are related in the same manner in each case, but are "tilted" or deformed with respect to the others. Tiling 219, p=5, is composed of pentagonal node-tiles 110 and has infill areas 68" derived from 68, and 154" derived from 154 by modifying the corners and reducing the size. Tiling 220, p=7, is composed of heptagonal node-tiles 21, strut-tiles 22, and infill tiles 37", 71" and 156" which are variants of 37, 71 and 156. Tiling 221, p=8, has octagonal node-tiles 32 and infill tiles 66', 214" and 152". Tiling 222, p=9, has nonagonal node-tiles 47 and infill tiles 111", 215" and 216". The source convex and non-convex hexagons, 111, 215 and 216 are also shown. Tiling 223, p=10, is similar to 219 but has decagonal nodes 35. The infill areas are correspondingly different and are marked as 68''' and 154'''; the source hexagons 68 and 154 are shown in the tiling. Tiling 224, p=12, is composed of dodecagonal nodes 41 and infill areas 40", 49" and 70" based on the polygons 40, 49 and 70 which are also shown.

FIG. 35 shows a portion of a non-periodic tiling based on p=31 nodes. The tiling 225 is topologically identical to the six tilings shown in FIG. 35. The areas marked D, E, F, G are also isomorphic. The tiling is composed of hexagons 113, 217 and 218. Its variant has 31-sided node-tiles 112, strut-tiles 22 and infill tiles 113", 217" and 218". The cut-outs in the infill tiles are shown in the tiles marked C and D. Illustration 226 is a detail of 225 and shows the angle-numbers at the vertices of the tiles. At every vertex of the tiling, the sum of the angle-numbers equals 31. In the general case, this sum equals p. This rule guarantees the tiles will leave no gaps and is the rule for plane-filling.

Figure 36:
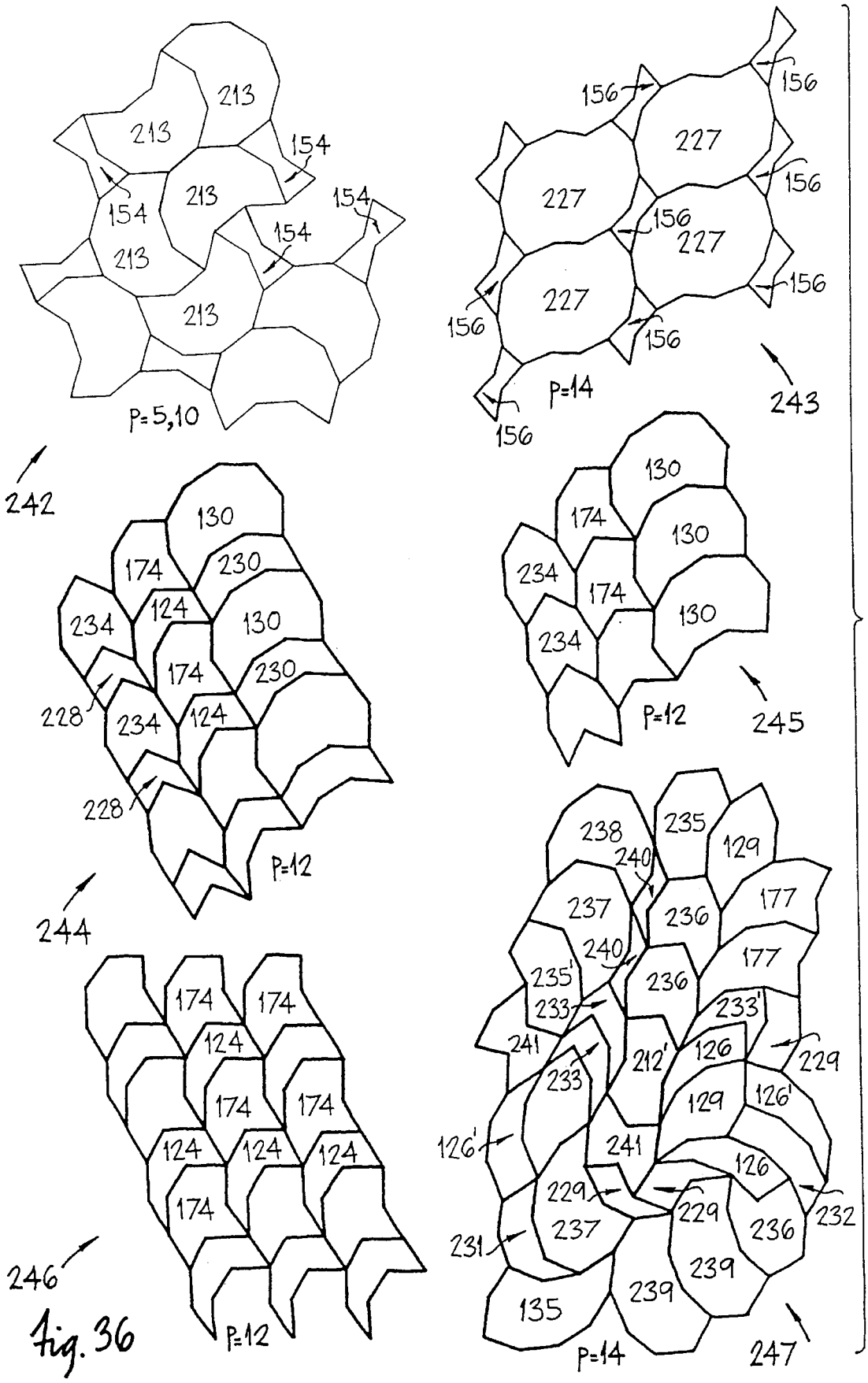
FIG. 36 shows various examples of periodic and non-periodic tilings which combine singly-concave tiles with doubly-concave tiles.

FIG. 36 shows periodic and non-periodic tilings composed of two or more different non-convex tiles. Tiling 242, p=5 or 10, is a non-periodic tiling and is composed of two tiles each having mirror symmetry, a singly-concave crescent tile 213 and a bi-concave hexagon 154. Tiling 243, p=14, is a periodic tiling composed of bi-concave hexagons 156 and an S-shaped tile 227 of FIG. 29. Tilings 244 and 245, both p=12 cases, can be either periodic or non-periodic. In the non-periodic case, the tiling can be extended periodically in one direction and non-periodically in the other. Tiling 244 is composed of six different non-convex polygons of which five tiles, namely, the hexagon 228, the octagons 124, 230 and 234, and the decagon 130, are singly-concave, and the tile 174 is bi-concave. Tiling 245 can be derived from 244 by removing alternating rows. Tiling 246, p=12, is a periodic tiling composed of two different octagons, the singly-concave 124 and the doubly-concave 174. Tiling 247, p=14, is a non-periodic tiling and is not only completely random, but it is composed of eighteen different tiles. Clearly, this example suggests that any combination of tiles from a fixed value of p can be tiled with one another, as long as the angle-numbers at every vertex adds up to p.

Figure 37:
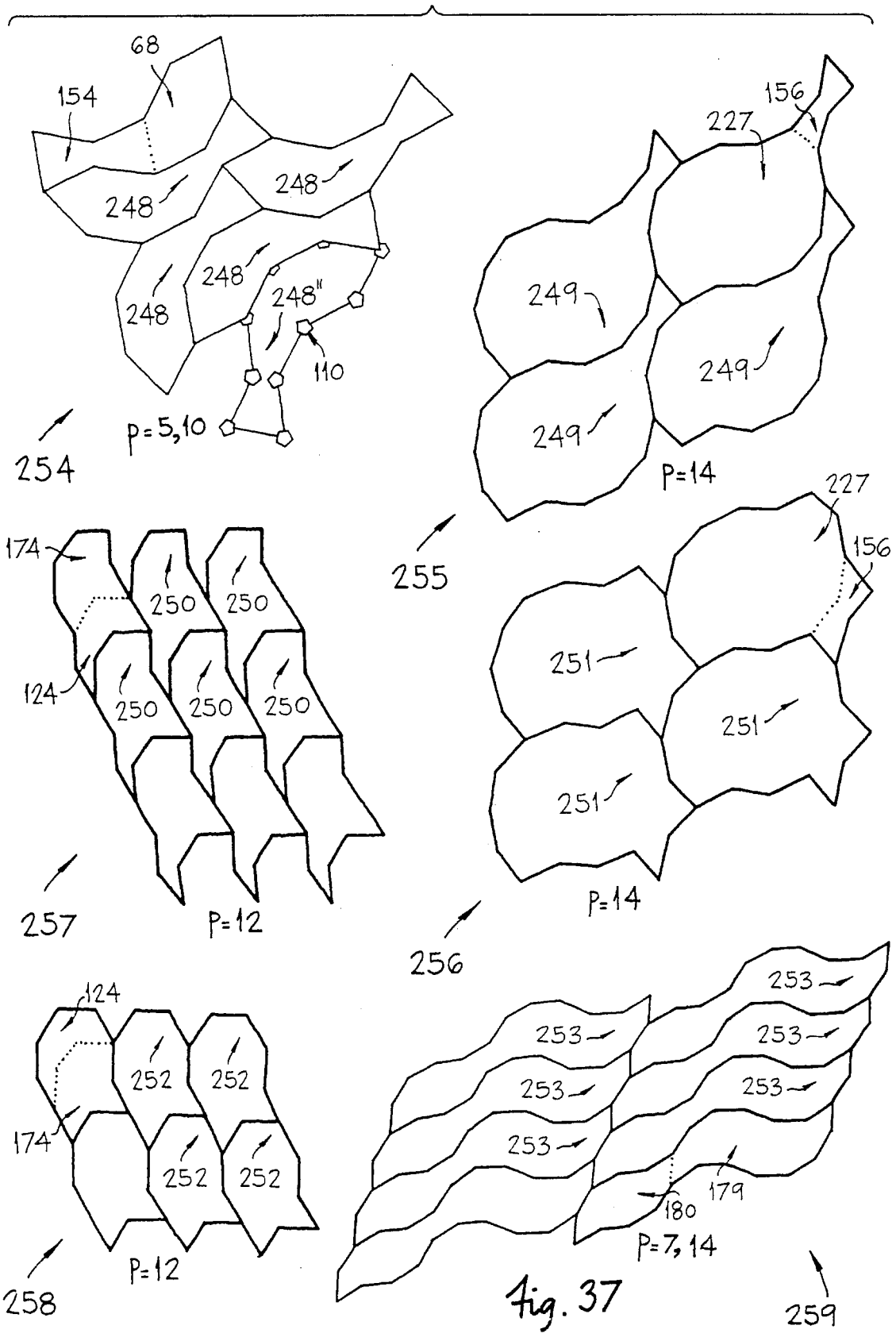
FIG. 37 shows complex polygonal tile shapes obtained by "fusing" two tiles into one. The tiles can be shaped to resemble living or imaginary creatures.

FIG. 37 shows examples of tiling patterns obtained by "fusing" two adjacent tiles into another. This technique suggests that Escher-like patterns can be obtained from polygonal tiles with specific angles determined by the value of p. Thus representational images from the natural, man-made or imaginary worlds can be "shaped" polygonally. For example, the tiling 254, p=5, is a non-periodic tiling composed of fish-like shapes 248, and is obtained by fusing the convex hexagon 68 with a non-convex hexagon 154. The pentagonal nodes 110, and the infill-tile 248" is shown alongside, and the tiling is based on FIG. 9 of the parent application. The tiling 249, p=14, a periodic tiling of polygons 249 suggesting drumsticks, is obtained by fusing 156 and the 227 (compare with tiling 243 from which it is derived). Tiling 251 is also derived from tiling 243 of FIG. 36 by fusing the same two polygons in a different way to obtain the shape 251. Tilings 257, p=12, are periodic tilings obtained from tiling 246 of FIG. 36 by fusing the two tiles 174 and 124 in two ways to produce polygons 250 and 252. Tiling 259, p=7 or 14, is obtained by fusing two S-shaped tiles 179 and 180 to produce the sinuous shape 253. Similarly, other tilings with fused polygons can be derived. In each of the cases shown, the tiles could be converted into various creatures, fish, birds, etc. Suitable markings and surface designs on the tiles can be added to enhance the representational meaning of the shape.

Variations of the tilings shown can be derived in many ways. These include decomposition of tiles into other tiles, dissections of convex and non-convex tiles, shaping the edges by curves or line segments, elongation or shrinkage of the edges, and deriving 3-dimensional prisms from the tiles. These variations are shown in FIGS. 38–40.

Figure 38:
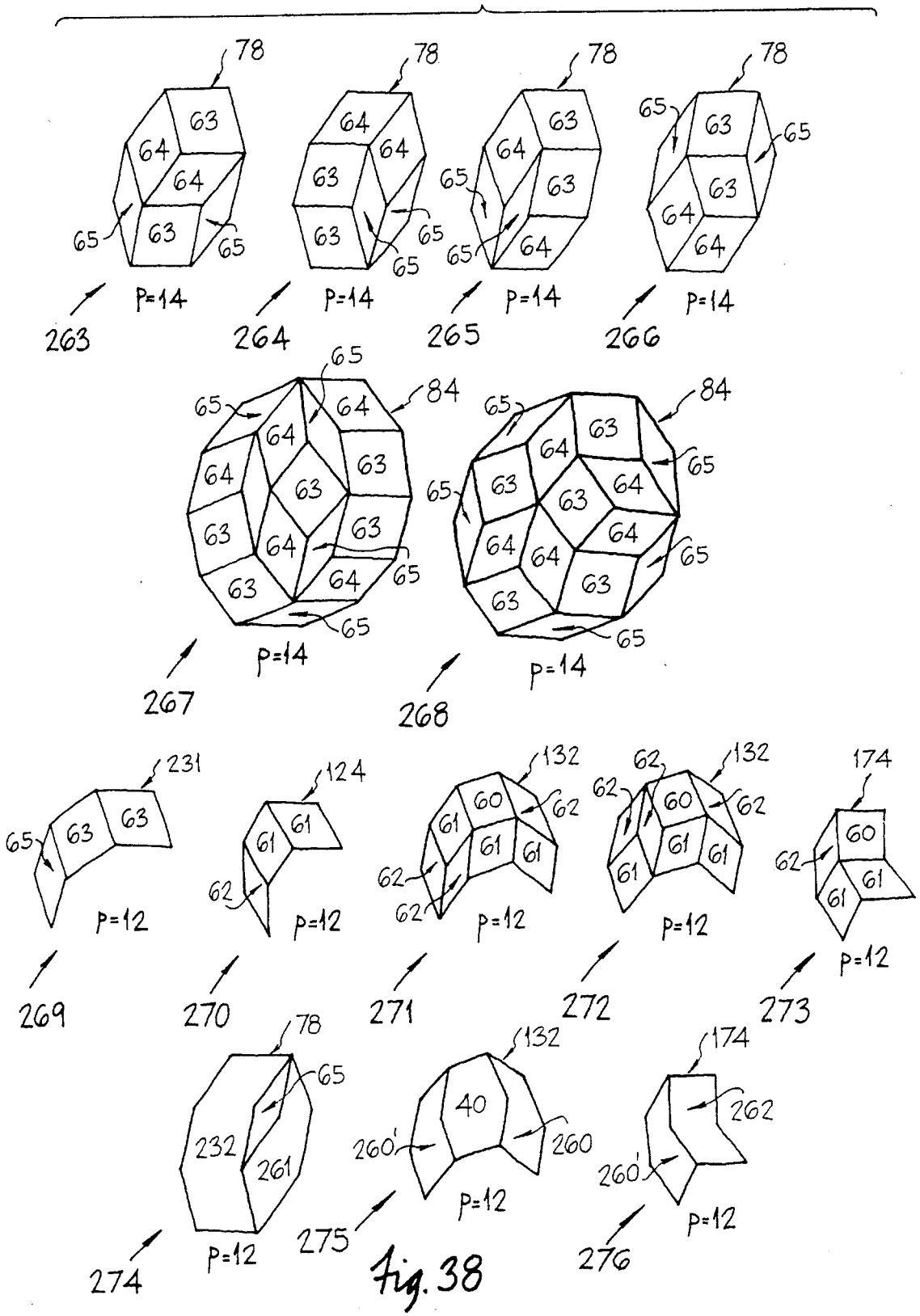
FIG. 38 shows the decomposition of various convex and non-convex polygons into rhombii and other convex and non-convex polygons.

FIG. 38 shows examples of convex and non-convex tiles decomposed into rhombii and other polygons. Examples include the decomposition of two convex zonogons and four non-convex polygons. Four decompositions of the convex octagon 78, p=14, are shown in 263–266, each composes of a pair of three different rhombii 63, 64 and 65. The dodecagon 84, p=14, is decomposed into fifteen rhombii, composed of five each of rhombii 63, 64 and 65, as shown with two examples in 267 and 268. The singly non-convex octagon 231 , p=14, is decomposed into three rhombii, two of 63 and one of 64, as shown in 269. Similarly, the non-convex octagon 124, p=12, is decomposed into two of 61 and one of 62, as shown in 270. Two different decompositions of the non-convex decagon 132, p=12, into rhombii 60, 61 and 62, is shown in 271 and 272. The doubly-convex octagon 174, p=12, composed of four rhombii is shown in 273. The convex octagon 78, p=14, is decomposed into two different singly-convex polygons 232 and 261 and a rhombus 65, as shown in 274. The non-convex decagon 132, p=12, is decomposed into a convex hexagon 40 and two non-convex hexagons 260 and 260', as shown in 275. The non-convex octagon 174 is decomposed into two non-convex hexagons 260' and 262, as shown in 276.

Figure 39:
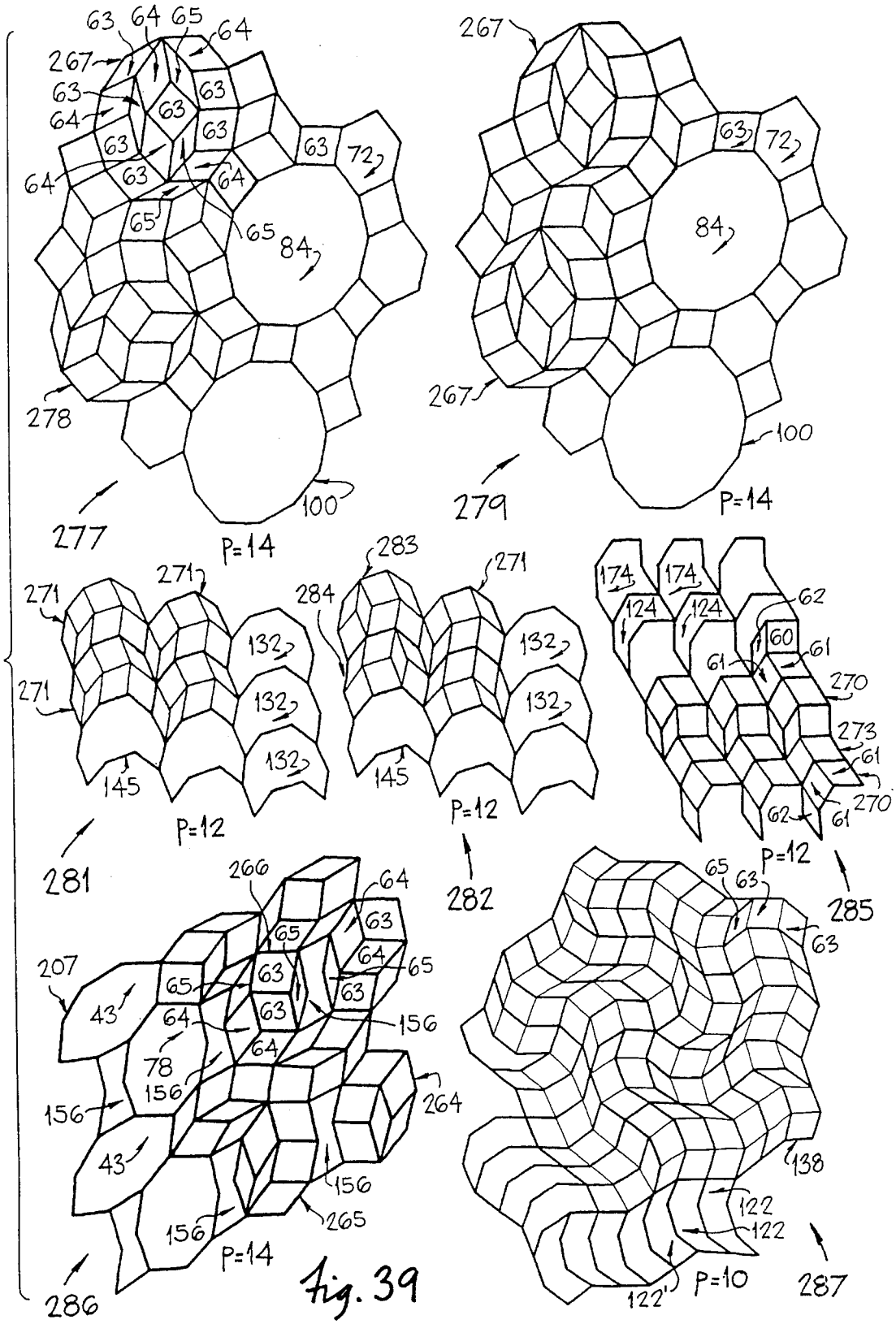
FIG. 39 shows periodic and non-periodic tilings obtained by decomposing non-rhombic periodic and non-periodic tilings into rhombii.
Figure 40:
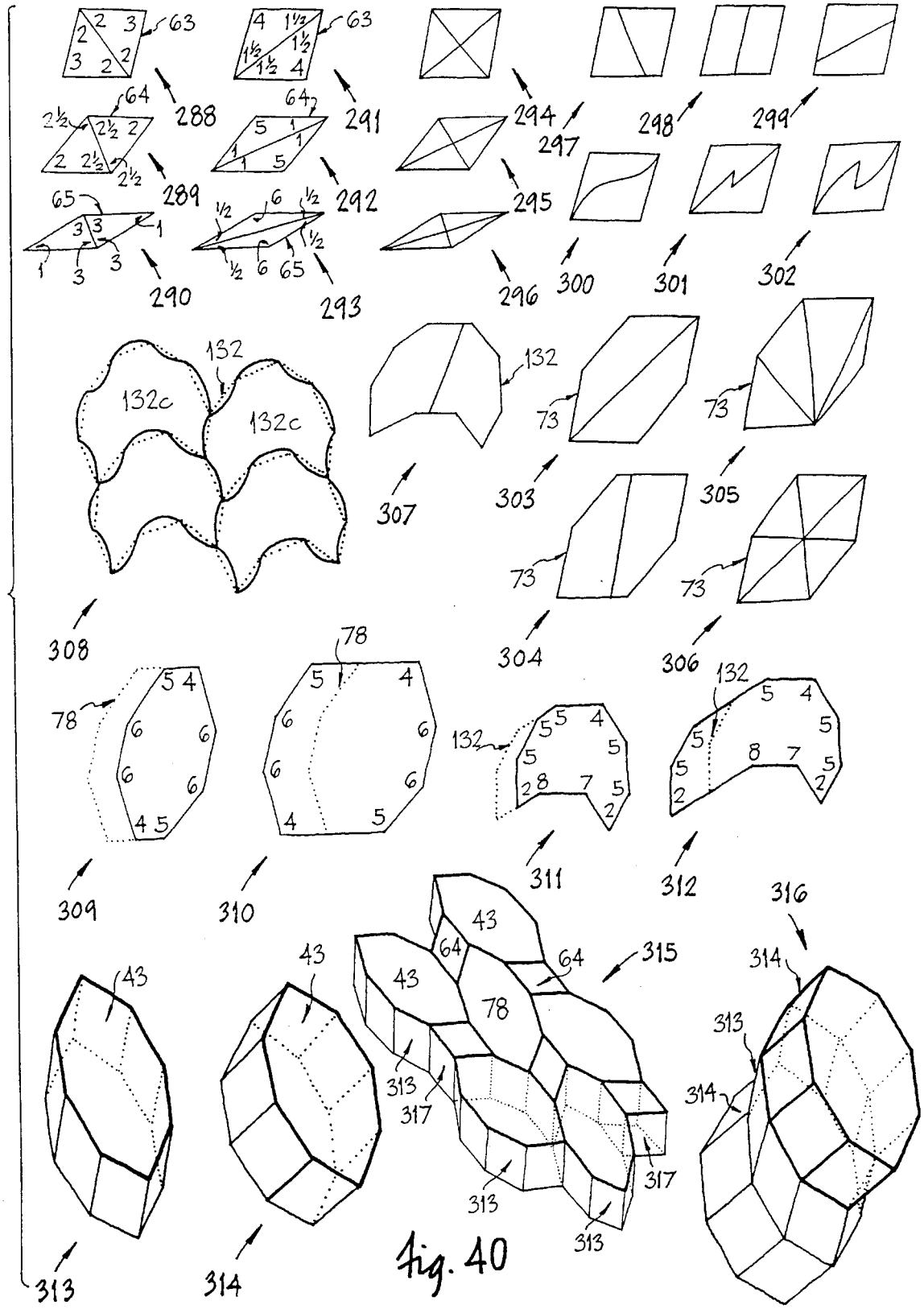
FIG. 40 shows techniques of dissections, curving edges, stretching or shortening of sides for deriving variants of equi-edged tiles. 3-dimensional extensions of tilings into space-filling prisms and blocks is also shown.

FIG. 39 shows tilings obtained by decomposing individual tiles of a few periodic and non-periodic tilings shown earlier. In all examples, only a portion of the tiling is shown decomposed.

Tilings 277 and 279 are decompositions of the periodic tiling 100 of FIG. 10. When all dodecagons 84 are decomposed alike, say as 267, the periodic rhombic tiling 279 is obtained. When the dodecagons are decomposed differently, the non-periodic rhombic tiling 277 is obtained; here the two different dodecagons are 267 and 284. Further, in 279, the hexagons 72 are decomposed alike, while in 277, the hexagons may or may not be decomposed alike.

Rhombic tilings 281 and 282, p=12, are derived from the periodic tiling 145 of FIG. 20 which is composed of non-convex decagons 132. Tiling 281 is periodic and uses the decomposition 271. Tiling 282 is non-periodic since several different decompositions, namely, 271,283 and 284 are used.

Tiling 285, p=12, is a periodic tiling based on the decomposition of the tiling 246 of FIG. 36, composed of non-convex 124 and 174; the latter two are here decomposed into 270 and 273, respectively.

Non-periodic tiling 286, p=14, is based on the periodic tiling 207 of FIG. 33 and composed of octagons 43 and 78, and the hexagon 156. After decomposition, the hexagons 156 remain unchanged, while the octagons are decomposed in different ways as shown. The four decompositions 263–266 of the octagon 78 can be seen. The octagon 43 is similarly decomposed in four different ways.

The central tiling 287, p=10, is a decomposition of the tiling 138 of FIG. 19. Each non-convex octagon 122 or 122' is decomposed into three rhombii, a pair of 63 and one 65.

FIG. 40 show various ways of extending the scope of the application. All convex and non-convex polygons described so far can be dissected into two or more parts by straight or curved lines. Unlike the decompositions described in FIG. 38, here the lines of dissections may be arbitrary. The angle-numbers of the dissected pieces in such cases are no longer integers.

All rhombii of FIG. 4 can be dissected into two equal parts by the diagonal as shown in 288–293 for the three rhombii 63–65 of p=14. When both diagonals are used, the rhombus is divided into four right-angled triangles as shown in 294–296. The lines of dissections need not pass through the vertices as in 297–299. Curved diagonals, or several line segments could be used to divide the rhombus into two equal or unequal parts. 300–302 show three examples.

Similarly all higher zonogons shown in FIGS. 4–7 can be dissected into two or more parts. An example is shown with the hexagon 73, p=14. In 303 and 304 it is dissected into two equal parts, in 305 it is divided into four different pieces, in 306 it is divided into six triangles. One example of a dissection of a non-convex polygon is shown in 307 with the decagon 132, p=12. All other singly-concave, doubly-concave and multiply-concave tiles can be similarly dissected.

The edges of the tiles can be curved in various ways. In 308, the tiling 145 of FIG. 20, p=12, and shown in dotted lines, is transformed by changing the tile 132 to 132*c* with curved edges. The individual tiles can be stretched or elongated in one or more directions, keeping all the angle-numbers unchanged. As an example, the convex tile 78, p=14, is shrunk to 309 and elongated to 310. Similarly, the non-convex tile 132 is shrunk to 311 and elongated to 312. In all four examples, the dotted line shows the boundary of the original tile.

All convex and non-convex tiles described in this application can be converted into prismatic (polyhedral) blocks of any height by increasing the thickness of the tile. This was already described in FIGS. 15–18 of the parent application, though in a different way. As an example, the convex tile 43, p=14, is raised to an upright prism 313, or an inclined prism 314. The periodic array 315 of upright prisms 313 and 317 is similarly based on the tiling 98 of FIG. 10. The prisms can be stacked in multi-layers 316 as shown with prisms 313 and 314. Similarly, space-filling layers of convex and non-convex prisms can be derived from all the tilings described in this application.

When the prisms are constructed hollow, architectural spaces are possible. The faces of the prisms can be constructed as prefabricated panels of any suitable material, or cast in one piece, and held in place with suitable connection devices and joining details. The walls could be load-bearing surfaces or structurally free as infill panels. Suitable openings can be introduced in the walls, floors or ceilings, to permit a spatial link between adjoining spaces. The vertical and inclined edges could be converted into load-bearing columns and the horizontal edges into structural beams, providing an alternative to the node-and-strut system already described in the parent application. Alternatively, all edges could be constructed as a rigid frame structure, with non-load bearing walls introduced. The rigid frames could be converted into arches or trusses as other variants of building systems based on the invention. In summary, for a fixed value of p, all convex zonogons (including even-sided regular polygons) shown in part in FIGS. 4–8, even-sided singly-concave tiles (FIGS. 12, 14–18), even-sided doubly-concave tiles (FIGS. 21,23,24,26 and 27) and even-sided multiply-concave tiles (part of FIG. 31 ), can be mixed and matched with each other in a large number of combinations. In addition, some tiles can tile by themselves. The tiling rule is simple: the sum of angle-numbers at a vertex must add up to p. The tiling configurations could be periodic or non-periodic, with or without rules. From the tilings illustrated herein, other tilings can be derived by dissecting each tile into smaller convex and/or nonconvex tiles (as per FIG. 38 and FIGS. 12, 14–18, 21, 23, 24, 26, 27 and 31 illustrating the derivation of non-convex tiles from convex zonogons). Further, for each combination of tiles, different tiling configurations are possible by re-arranging the same tiles.

Though selected examples and preferred embodiments have been described, it will be clear to those skilled in the art that various modifications can be made without departing from the scope of the invention.

What is claimed is:

1. A family of periodic space structure configurations for design applications, the combination comprising:

a plurality of substantially planar, even-sided singly-concave polygonal tiles having a thickness and arranged in layers, each said tile having m edges which meet at m vertices at interior angles defined by the angle between adjacent said edges on the interior of said tile where said edges are composed of m/2 pairs of parallel edges and wherein said plurality comprises at least one said tile with m greater than 6, and at least one tile without mirror-symmetry, said tiles are engaged together to fill space, said edges comprise two sets of contiguous edges, first said set having convex interior angles and second set having concave interior angles said edges are substantially equal in length and said interior angles are whole number multiples of 360°/p, and where p is any number greater than 4.

2. A family of non-periodic space structure configurations for design applications, the combination comprising:

a plurality of substantially planar, even-sided singly-concave polygonal tiles having a thickness and arranged in layers, each said tile having m edges which meet at m vertices at interior angles defined by the angle between adjacent said edges on the interior of said tile, where said edges are composed of m/2 pairs of parallel edges and wherein said plurality comprises at least one said tile without mirror symmetry, said tiles are engaged together to fill space, and said edges comprise two sets of contiguous edges, first said set having convex interior angles and second said set having concave interior angles said edges are substantially equal in length and said interior angles are whole number multiples of 360°/p, and where p is any number greater than 4.

3. A family of periodic space structure configurations for design applications, the combination comprising:

a plurality of substantially planar, even-sided polygonal tiles having a thickness and arranged in layers, each said tile having m edges which meet at m vertices at interior angles defined by the angles between adjacent said edges on the interior of said tile and where said edges are composed of m/2 pairs of parallel edges, said tiles are engaged together to fill space, said plurality comprises a combination of convex zonogons with m greater than 2 and singly-concave polygons comprising at least one said singly-concave polygon with m greater than 6, wherein at least one said tile is without mirror-symmetry, and wherein said singly-concave is composed of two sets of contiguous edges, first said set having convex interior angles and second said set having concave interior angles, said edges are substantially equal in length and said interior angles are whole number multiples of 360°/p, and where p is any number greater than 4.

4. A family of non-periodic space structure configurations for design applications, the combination comprising:

a plurality of substantially planar, even-sided polygonal tiles having a thickness and arranged in layers, each said tile having m edges which meet at m vertices at interior angles defined by the angles between adjacent said edges on the interior of said tile and where said edges are composed of m/2 pairs of parallel edges and wherein, said tiles are engaged together to fill space, said plurality comprises a combination of convex zonogons with m greater than 2 and singly-concave polygons with m greater than 4, each said tile having mirror-symmetry, wherein said singly concave polygons are composed of two sets of contiguous edges, first said set having convex interior angles and second said set having concave interior angles, said edges are substantially equal in length and said interior angles are whole number multiples of 360°/p, and where p is any number greater than 4.

5. A family of non-periodic space structure configurations for design applications, the combination comprising:

a plurality of substantially planar, even-sided polygonal tiles having a thickness and arranged in layers, each said tile having m edges which meet at m vertices at interior angles defined by the angles between adjacent said edges on the interior of said tile and where said edges are composed of m/2 pairs of parallel edges and wherein said tiles are engaged together to fill space, said plurality comprises a combination of convex zonogons with m greater than 2 and singly-concave polygons with m greater than 4, at least one said tile being without mirror-symmetry, wherein said singly concave polygons are composed of two sets of contiguous edges, first said set having convex interior angles and second said set having concave interior angles, said edges are substantially equal in length and said interior angles are whole number multiples of 360°/p, and where p is any number greater than 4.

6. A family of periodic space structure configurations for design applications, the combination comprising:

a plurality of substantially planar, even-sided polygonal tiles having a thickness and arranged in layers, each said tile having m edges which meet at m vertices at interior angles defined by the angles between adjacent said edges on the interior of said tile and where said edges are composed of m/2 pairs of parallel edges and wherein said tiles are engaged together to fill space, said plurality comprises a combination of singly-concave polygons and doubly-concave polygons, each said polygon having mirror-symmetry and m greater than 4, wherein said singly concave polygons are composed of two sets of contiguous edges, first said set having convex interior angles and second said set having concave interior angles, said doubly-concave polygons are composed of two sets of contiguous edges, each said set of edges having concave interior angles, where said sets are joined to each other by additional edges which meet said sets of edges at convex interior angles, said edges are substantially equal in length and said interior angles are whole number multiples of 360°/p, and where p is any number greater than 4.

7. A family of periodic space structure configurations for design applications, the combination comprising:

a plurality of substantially planar, even-sided polygonal tiles having a thickness and arranged in layers, each said tile having m edges which meet at m vertices at interior angles defined by the angles between adjacent said edges on the interior of said tile and where said edges are composed of m/2 pairs of parallel edges and wherein said tiles are engaged together to fill space, said plurality comprises a combination of singly-concave polygons and doubly-concave polygons, each said polygon having m greater than 4 and at least one said polygon being without mirror-symmetry, wherein said singly concave polygons are composed of two sets of contiguous edges, first said set having convex interior angles and second said set having concave interior angles, said doubly-concave polygons are composed of two sets of contiguous edges, each said set of edges having concave interior angles, where said sets are joined to each other by additional edges which meet said sets of edges at convex interior angles, said edges are substantially equal in length and said interior angles are whole number multiples of 360°/p, and where p is any number greater than 4.

8. A family of non-periodic space structure configurations for design applications, the combination comprising:

a plurality of substantially planar, even-sided polygonal tiles having a thickness and arranged in layers, each said tile having m edges which meet at m vertices at interior angles defined by the angles between adjacent said edges on the interior of said tile and where said edges are composed of m/2 pairs of parallel edges and wherein said tiles are engaged together to fill space, said plurality comprises a combination of singly-concave polygons and doubly-concave polygons, each said polygon having mirror-symmetry and m greater than 4, wherein said singly concave polygons are composed of two sets of contiguous edges, first said set having convex interior angles and second said set having concave interior angles, said doubly-concave polygons are composed of two sets of contiguous edges, each said set of edges having concave interior angles, where said sets are joined to each other by additional edges which meet said sets of edges at convex interior angles, said edges are substantially equal in length and said interior angles are whole number multiples of 360°/p, and where p is any number greater than 4.

9. A family of non-periodic space structure configurations for design applications, the combination comprising:

a plurality of substantially planar, even-sided polygonal tiles having a thickness and arranged in layers, each said tile having m edges which meet at m vertices at interior angles defined by the angles between adjacent said edges on the interior of said tile and where said edges are composed of m/2 pairs of parallel edges and wherein said tiles are engaged together to fill space, said plurality comprises a combination of singly-concave polygons and doubly-concave polygons, each said polygon having m greater than 4 and at least one said polygon being without mirror-symmetry, wherein said singly concave polygons are composed of two sets of contiguous edges, first said set having convex interior angles and second said set having concave interior angles, said doubly-concave polygons are composed of two sets of contiguous edges, each said set of edges having concave interior angles, where said sets are joined to each other by additional edges which meet said sets of edges at convex interior angles, said edges are substantially equal in length and said interior angles are whole number multiples of 360°/p, and where p is any number greater than 4.

10. Configurations, as per claims 1, 2, 3, 4, 5, 6, 7, 8 or 9 wherein:

said tiles are upright or inclined prisms of any height, wherein said prisms make space-filling 3-dimensional polyhedral blocks.

11. Space structure configurations as per claim 10, wherein the said polyhedral blocks are hollow spaces usable for architectural and other functions.

12. Configurations as per claims 1, 2, 3, 4, 5, 6, 7, 8, or 9 wherein the said tiles are modified by dissections of said tiles into two or more parts.

13. Configurations as per claims 1, 2, 3, 4, 5, 6, 7, 8, or 9 wherein the said tiles in the said plurality are modified by replacing the edges of the tiles by curved line segments such that the area of the tile remains unchanged.

14. Configurations as per claims in 1, 2, 3, 4, 5, 6, 7, 8, or 9 wherein the said tiles in the said plurality are modified by elongating or shrinking the tile in one or more directions.

15. Configurations as per claims 1, 2, 3, 4, 5, 6, 7, 8, or 9 wherein the said tiles are modified by decomposition of said tiles into rhombii with interior angles which are also integer multiples of A, and where the sum of the interior angles of each rhombus equals p multiplied by A.

16. Configurations as per claims 1, 2, 3, 4, 5, 6, 7, 8, or 9 wherein the said tiles are modified by decomposition into convex and non-convex polygonal tiles with interior angles which are also integer multiples of A.

17. Configurations as per claims 2, 4, 5, 8 or 9 selected from the group comprising:

configurations which are periodic in one direction and non-periodic in another direction, configurations which have an overall p-fold symmetry around a center, configurations which have no translational symmetry in any direction.

18. Configurations as per claims 1 or 2, selected from the group comprising:

configurations wherein all said singly-concave polygons are identical, configurations wherein said singly-concave polygons have the same number of sides but different said interior angles, configurations wherein said singly-concave polygons have different number of sides.

19. Configurations as per claim 3, 4 or 5 selected from the group comprising the following:

configurations wherein said convex zonogons are rhombii,

Configurations wherein said convex zonogons have the same number of sides, each with m greater than four configurations wherein said convex zonogons have different number of sides configurations wherein said singly-concave polygons have the same number of sides, configurations wherein said singly-concave polygons have different number of sides.

20. Configurations per as claims 6, 7, 8 or 9 selected from the group comprising the following:

configurations wherein said singly-concave polygons have the same number of sides, configurations wherein said singly-concave polygons have different number of sides, configurations wherein said doubly-concave polygons have the same number of sides, configurations wherein said doubly-concave polygons have different number of sides.

21. Configurations as per claim 13, wherein the said rhombii are dissected into two parts of equal area by a line joining the opposite pairs of vertices or edges, wherein the said line is straight or curved, the said parts are a pair of isoceles triangles with apex angles equal to the interior face angles of the rhombii, wherein p is greater than 5.

22. Configurations as per claim 13, wherein the said rhombii are dissected into four parts of equal area by a pair of lines joining the opposite pairs of vertices or edges, wherein the said lines are straight or curved, and the said four parts are right-angled triangles.

* * * * *